US006026253A

United States Patent [19]

Domon et al.

[11] Patent Number: 6,026,253

[45] Date of Patent: Feb. 15, 2000

[54] ELECTROPHOTOGRAPHIC IMAGE FORMING APPARATUS AND A DEVELOPING UNIT AND A PROCESS CARTRIDGE MOUNTABLE TO A MAIN BODY THEREOF EACH INCLUDING A PORTION FOR DETECTING THE REMAINING AMOUNT OF A DEVELOPING AGENT CONTAINED IN THE DEVELOPING UNIT

[75] Inventors: Akira Domon, Kashiwa; Yasushi Shimizu, Toride, both of Japan

[73] Assignee: Canon Kabushiki Kaisha, Tokyo, Japan

[21] Appl. No.: 09/053,749

[22] Filed: Apr. 2, 1998

[30] Foreign Application Priority Data

Apr. 4, 1997 [JP] Japan ..... 9-102659
Mar. 26, 1998 [JP] Japan ..... 10-079298

[51] Int. Cl.[7] ..... G03G 15/08

[52] U.S. Cl. ..... 399/30; 399/27; 399/103

[58] Field of Search ..... 399/13, 30, 29, 399/61, 62, 27, 119, 28, 114, 103

[56] References Cited

U.S. PATENT DOCUMENTS

| | | | |
|---|---|---|---|
| 4,951,091 | 8/1990 | Nawata | 399/27 |
| 5,105,219 | 4/1992 | Yoshikado | 399/27 |
| 5,229,821 | 7/1993 | Fujii | 399/28 |
| 5,488,459 | 1/1996 | Tsuda et al. | 399/167 |
| 5,565,961 | 10/1996 | Shoji et al. | 399/111 |
| 5,589,918 | 12/1996 | Oshia et al. | 399/114 |
| 5,602,623 | 2/1997 | Nishibata et al. | 399/111 |
| 5,617,579 | 4/1997 | Yashiro et al. | 399/114 |
| 5,682,574 | 10/1997 | Oshia et al. | 399/64 |
| 5,784,665 | 7/1998 | Bae | 399/27 X |

FOREIGN PATENT DOCUMENTS 7-306582 11/1995 Japan .

*Primary Examiner*—Susan S. Y. Lee
*Attorney, Agent, or Firm*—Fitzpatrick, Cella, Harper & Scinto

[57] ABSTRACT

An electrophotographic image forming apparatus for forming an image on recording medium, includes a mounting portion capable of detachably mounting a developing unit including a developing member for developing a latent image formed on an electrophotographic photosensitive member, a developing agent containing portion for containing developing agent to be supplied to the developing member and a signal output member for outputting a signal corresponding to a remaining amount of developing agent contained in the developing unit, and a remaining amount detecting portion for detecting the remaining amount of the developing agent contained in the developing unit when the developing unit is mounted to the mounting portion. The remaining amount detecting portion detects a pre-signal outputted from the signal output member prior to image formation, to detect the remaining amount of the developing agent on the basis of a detected result.

23 Claims, 18 Drawing Sheets

ELECTROPHOTOGRAPHIC IMAGE FORMING APPARATUS AND A DEVELOPING UNIT AND A PROCESS CARTRIDGE MOUNTABLE TO A MAIN BODY THEREOF EACH INCLUDING A PORTION FOR DETECTING THE REMAINING AMOUNT OF A DEVELOPING AGENT CONTAINED IN THE DEVELOPING UNIT

BACKGROUND OF THE INVENTION

1. Field of the Invention

The present invention relates to an electrophotographic image forming apparatus, a developing unit and a process cartridge.

The "electrophotographic image forming apparatus" is an apparatus for forming an image on a recording medium by using an electrophotographic image forming system. For example, the electrophotographic image forming apparatus may be an electrophotographic copying machine, an electrophotographic printer (for example, a laser beam printer or an LED printer), an electrophotographic facsimile or an electrophotographic word processor.

The "process cartridge" incorporates therein an electrophotographic photosensitive member and a developing means for developing a latent image formed on the electrophotographic photosensitive member as a cartridge unit which can be detachably mounted to a main body of an electrophotographic image forming apparatus. It incorporates therein, in addition to the developing means and the electrophotographic photosensitive member, at least one of a charge member for charging the electrophotographic photosensitive member and a cleaning member for removing developing agent remaining on the electrophotographic photosensitive member, as a cartridge unit which can detachably be mounted to a main body of an electrophotographic image forming apparatus.

2. Related Background Art

A conventional electrophotographic image forming apparatus such as an electrophotographic copying machine, a laser beam printer or the like includes a photosensitive drum. Well-known processes such as charging, exposure and development are successively effected regarding the photosensitive drum, thereby forming a toner image on the photosensitive drum and transferring the toner image onto a recording medium. Thereafter, residual toner remaining on the photosensitive drum is removed by a cleaning device. In this way, the image is formed.

In such electrophotographic image forming apparatuses, recently, a process cartridge has been adopted to make the apparatus compact and simplify the maintenance. In the process cartridge, the photosensitive drum and the process means (such as a charge member, a developing member and a cleaning member) acting on the photosensitive drum are integrally incorporated as a cartridge unit which can detachably be mounted to a main body of the image forming apparatus by an operator himself.

In such electrophotographic image forming apparatuses, powder developing agent is used. The developing agent is contained in a developing container of the process cartridge or a developing unit and is sent, by a developing agent convey means, to a developing agent bearing member which holds the developing agent. The developing agent held on the developing agent bearing member is shifted to an electrostatic latent image forming portion, where the electrostatic latent image formed on an image bearing member is visualized. Thereafter, the visualized image is transferred onto a transfer material, such as a paper sheet, by a transfer means and then is fixed to the transfer material by a fixing device. In this way, a series of image forming processes are finished, and a desired image can be obtained.

In such electrophotographic image forming apparatuses, as the number of prints or copies are increased, the developing agent in the process cartridge or the developing unit is decreased, thereby causing the poor printing. To avoid this, generally, there is provided a developing agent remaining amount detecting portion for informing the operator of the fact that the remaining amount of developing agent becomes small before poor printing is generated. For example, in a method for detecting the remained amount of the developing agent, the change in amount of developing agent in the developing container is measured as a change in electrostatic capacity to detect the remaining amount of the developing agent.

SUMMARY OF THE INVENTION

An object of the present invention is to provide an electrophotographic image forming apparatus, a developing unit and a process cartridge, in which the remaining amount of developing agent can be detected with high accuracy.

Another object of the present invention is to provide an electrophotographic image forming apparatus, a developing unit and a process cartridge, in which the remaining amount of developing agent can be detected with high accuracy by the influences of the accuracy of a signal output member for outputting a signal corresponding to the remaining amount of the developing agent of the tolerance of parts constituting an electric circuit associated with detection of the signal.

A further object of the present invention is to provide an electrophotographic image forming apparatus for forming an image on a recording medium, comprising a mounting portion capable of detachably mounting a developing unit including a developing member for developing a latent image formed on an electrophotographic photosensitive member, a developer containing portion for containing developing agent to be supplied to the developing member and a signal output member for outputting a signal corresponding to the remaining amount of developing agent contained in the developing unit; and a remaining amount detecting portion for detecting the remaining amount of the developing agent contained in the developing unit when the developing unit is mounted to the mounting portion. The remaining amount detecting portion detects a presignal outputted from the signal output member prior to image formation, thereby detecting the remaining amount of the developing agent on the basis of a detected result.

The other objects and features of the present invention will be apparent from the following detailed explanation of the invention referring to the accompanying drawings.

DETAILED DESCRIPTION OF THE PREFERRED EMBODIMENTS

Now, a process cartridge, a developing device (developing unit) and an electrophotographic image forming apparatus according to the present invention will be explained with reference to the accompanying drawings.

(First Embodiment)

A first embodiment of the present invention will be explained with reference to FIGS. 1 to 5.

Figure 3:
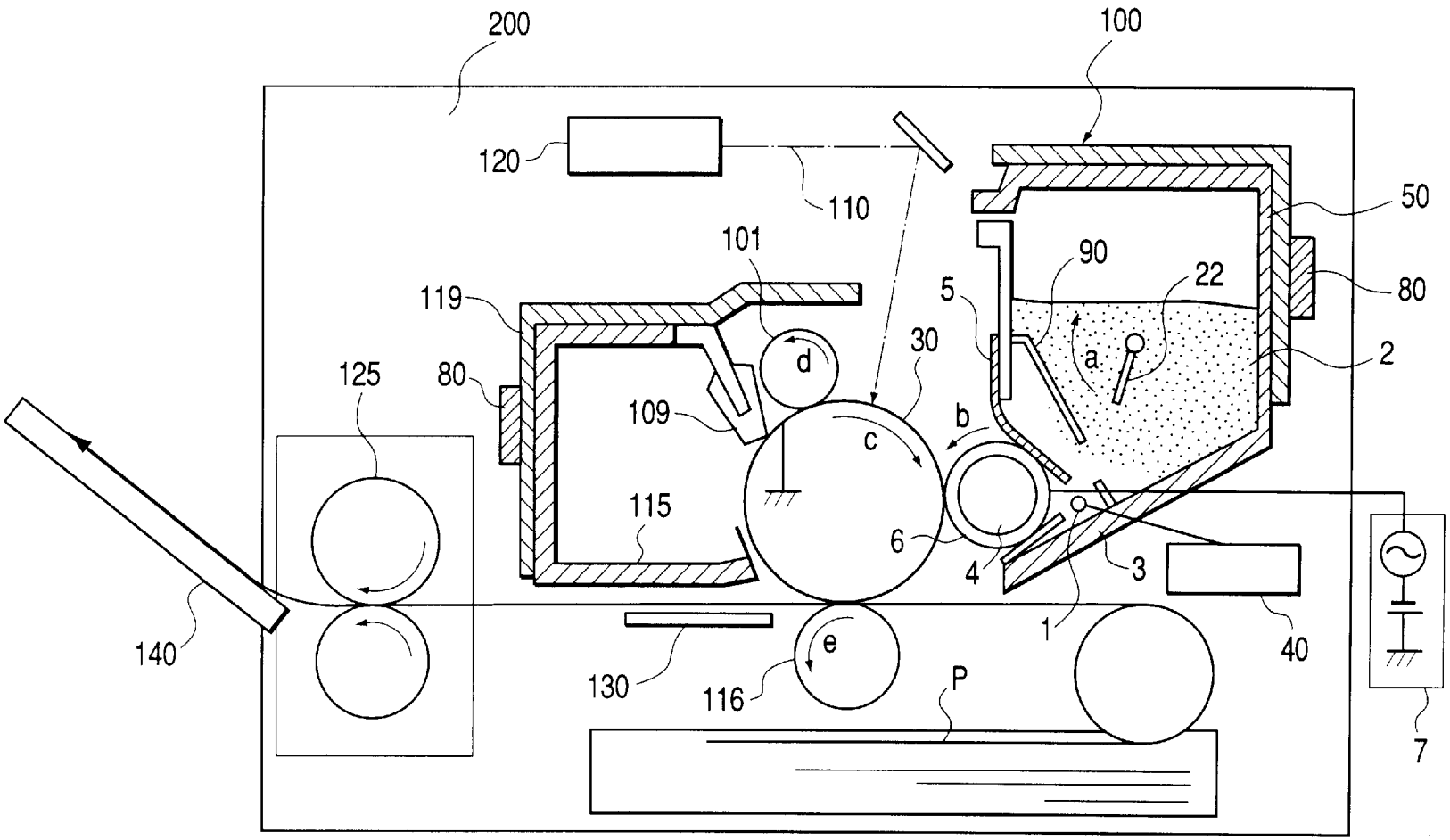
FIG. 3 is an elevational sectional view of an electrophotographic image forming apparatus to which the developing agent amount detecting device and a process cartridge are mounted.

First of all, the construction of an electrophotographic image forming apparatus including a developing agent remaining amount detecting device and a process cartridge according to the first embodiment will be described with reference to FIG. 3. The electrophotographic image forming apparatus 200 is constituted by a charge means, an electrophotographic photosensitive member, an exposure means, a developing device, a transfer device, a cleaning device and a fixing device. In the illustrated embodiment, among them, a charge roller 101 as the charge means, a photosensitive drum 30 as the electrophotographic photosensitive member, the developing device 50 and the cleaning device 119 are integrated in a compact manner to form a process cartridge 100 which is detachably mounted to a mounting means 80 of a main body of the image forming apparatus.

The photosensitive drum 30 is constituted by a hollow cylindrical aluminum base body and an organic photosensitive layer coated on the base body. The photosensitive drum 30 is rotated in a direction shown by the arrow c by a drive system (not shown) provided within the main body of the image forming apparatus. By applying a predetermined bias from a charge bias power source (not shown) to the charge roller 101 rotated in a direction shown by the arrow d, a surface of the photosensitive drum 30 is charged with desired potential. An electrostatic latent image is formed by illuminating the photosensitive drum 30 charged with the desired potential with a laser beam 110 emitted from a laser scanner unit 120.

Figure 1:
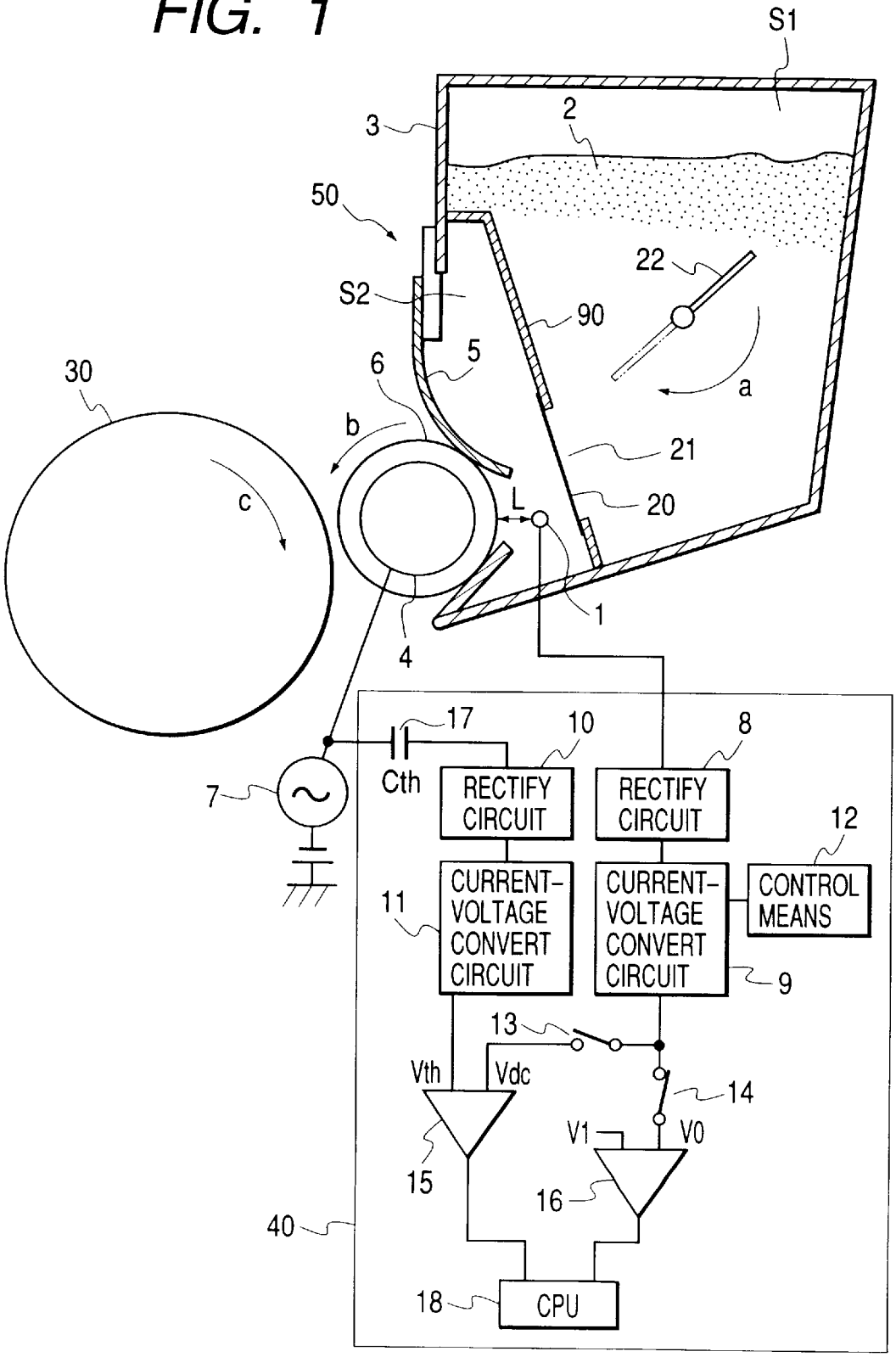
FIG. 1 is a constructural view of a developing agent amount detecting device according to a first embodiment of the present invention.
Figure 2:
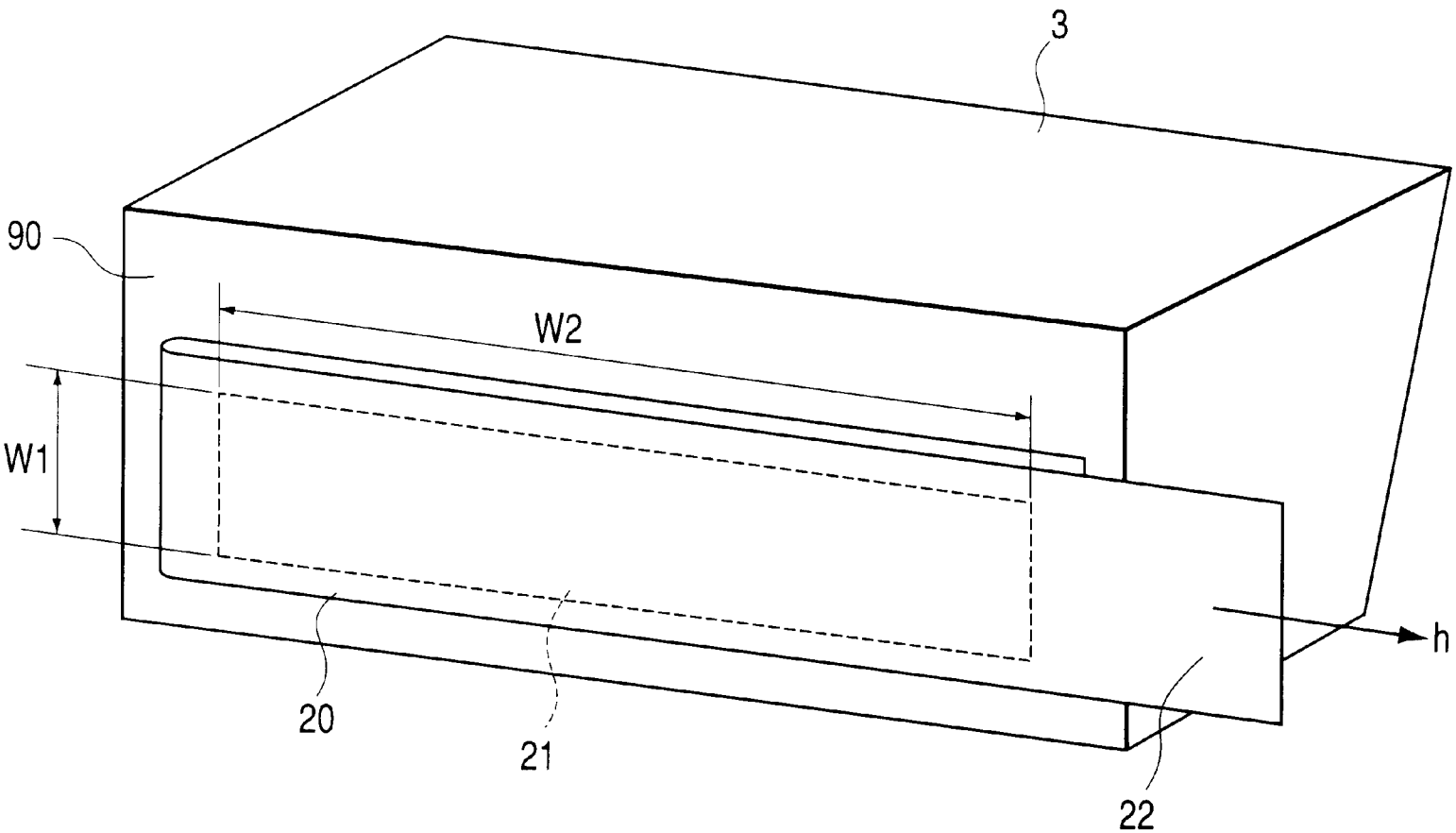
FIG. 2 is a perspective view showing a developing agent seal member of a developing container according to the first embodiment.

As shown in FIGS. 1 and 2, the developing device 50 has a developing container 3 for containing insulation one-component magnetic developer (referred to as "developing agent" hereinafter) 2 for visualizing the electrostatic latent image formed on the photosensitive drum 30, a hollow cylindrical developing roller (developing agent bearing member) 6 rotated in a direction shown by the arrow b and is opposed to the photosensitive drum 30 with a predetermined gap therebetween, a developing agent remaining amount detecting member 1 for detecting the electrostatic capacity changed in accordance with an amount of the developing agent existing between the developing roller 6 and the developing agent remaining amount detecting member and for informing the operator of the fact that the remaining amount of the developing agent becomes small. The developing device 50 also has a magnet roller 4 disposed within the developing roller 6, an elastic rubber blade (developing agent regulating member) 5 urged against the developing roller 6 to regulate the thickness of a layer of the developing agent 2 formed on the developing roller 6, a partition plate 90 for partitioning the interior of the developing container 3, an opening portion 21 formed in the partition plate 90, a developing agent seal member 20 for searingly closing the opening portion 21, and an agitating member 22 for agitating the developing agent.

Predetermined AC voltage and DC voltage are applied from an alternate current (AC) power source 7 to the developing roller 6 to cause the developing agent 2 to fly toward a latent image portion on the photosensitive drum 30. In the illustrated embodiment, an alternate wave form obtained by overlapping rectangular wave of 2000 Vpp and 2000 Hz with DC voltage of −500 V is used. The visualized developing agent image formed on the photosensitive drum 30 is transferred onto a transfer material P by a transfer means 116. Thereafter, the transfer material P is sent, by a convey means 130, to a fixing means 125, where the developing agent image is fixed to the transfer material. Then, the transfer material is discharged onto a tray 140 out of the main body.

After the transferring operation, residual developing agent 2 remaining on the photosensitive drum 30 is scraped by a cleaning blade 109 and is collected in a cleaning container 115. By repeating the above mentioned processes, a desired image can be obtained.

Next, the construction of the developing agent remained amount detecting device will be fully described with reference to FIGS. 1 and 2.

The developing agent remaining amount detecting device according to the present invention is constituted by the developing agent remaining amount detecting member 1 provided within the developing device 50, and a developing agent remaining amount detecting circuit 40 provided within the main body of the image forming apparatus. During the manufacture of the process cartridge, the interior of the developing container 3 is divided, by the partition plate 90 and the developing agent seal member 20, into two spaces, i.e., a space S1 in which the developing agent 2 exists and a space S2 in which the developing agent 2 does not exist. The opening portion 21 adapted to supply the developing agent and having a width WI of 30 mm and a length W2 of 220 mm is formed in the partition plate 90 flush with the partition plate. During the manufacture of the process cartridge, the opening portion 21 is searingly closed by the developing agent seal member 20 to confine the developing agent 2 within the developing container and to prevent the developing agent 2 from leaking out of the process cartridge 100 during transportation.

The developing agent seal member 20 is formed from a polyethylene sheet and, as shown in FIG. 2, is adhered to the developing container 3 at upper and lower edges of the opening portion 21. Further, the seal member is folded at one longitudinal end of the opening portion and protrudes out of the process cartridge 100 as a protruded portion 22. By pulling the protruded portion 22 in a direction shown by the arrow h, the developing agent seal member 20 is peeled from the developing container 3 and is discharged out of the process cartridge 100. As a result, the developing agent 2 passes through the opening portion 21 to reach the developing roller 6 and the elastic blade 5 and is born on the developing roller 6 to be used in the image formation.

The developing agent remaining amount detecting member 1 may be formed from conductive material, and, in the illustrated embodiment, a stainless steel rod having a diameter of 2 mm is used as the developing agent remaining amount detecting member. The developing agent remaining amount detecting member 1 may be disposed between the developing roller 6 and the opening portion 21, and, in the illustrated embodiment, the developing agent remaining amount detecting member is disposed in parallel with the developing roller 6 at a position spaced apart from the developing roller 6 by a distance L of 5 mm. An electrical contact (not shown) for connection to the developing agent remaining amount detecting circuit 40 is provided on one end of an extension of the developing agent remained amount detecting member 1.

The developing agent remaining amount detecting circuit 40 is connected to the developing agent remaining amount detecting member 1 in series and includes a first rectify circuit 8 for rectifying current generated in the developing agent remaining amount detecting member 1 in accordance with the amount of the developing agent existing between the developing agent remaining amount detecting member 1 and the developing roller 6, a first current-voltage convert circuit 9 having variable resistance therein and adapted to convert an electric signal generated in the first rectify circuit 8 into a voltage, and a control means 12 for adjusting a value of the variable resistance of the first current-voltage convert circuit 9.

The detecting circuit 40 further includes a capacitor 17 connected to the alternate current power source 7 in parallel with the developing roller 6 and having a predetermined capacity Cth, a second rectify circuit 10 connected to the capacitor 17 in series, a second current-voltage convert circuit 11, a first comparator 16, and a first switch 14 disposed between the first comparator 16 and the first current-voltage convert circuit 9. A voltage value V0 outputted from the first current-voltage convert circuit 9 is compared with an initial correction value V1 by the first comparator 16, and, when these values are the same, a signal is emitted.

The detecting circuit 40 further includes a second comparator 15, and a second switch 13 disposed between the second comparator 15 and the first current-voltage convert circuit 9. A voltage value Vdc outputted from the first current-voltage convert circuit 9 is compared with a voltage value Vth outputted from the second current-voltage convert circuit 11 by the second comparator 15, and, when these values are the same, a signal is emitted. The signals emitted from the first and second comparators 16, 15 are detected by a CPU 18. The CPU 18 serves to effect treatment, such as the display of warning of a developing agent remaining amount on the basis of a detected signals.

With the arrangement as mentioned above, the developing agent remaining amount detecting member 1 does not contact the developing agent from the time when the process cartridge is manufactured to the time when the developing agent seal member 20 is removed by the operator for using the process cartridge.

Figure 4:
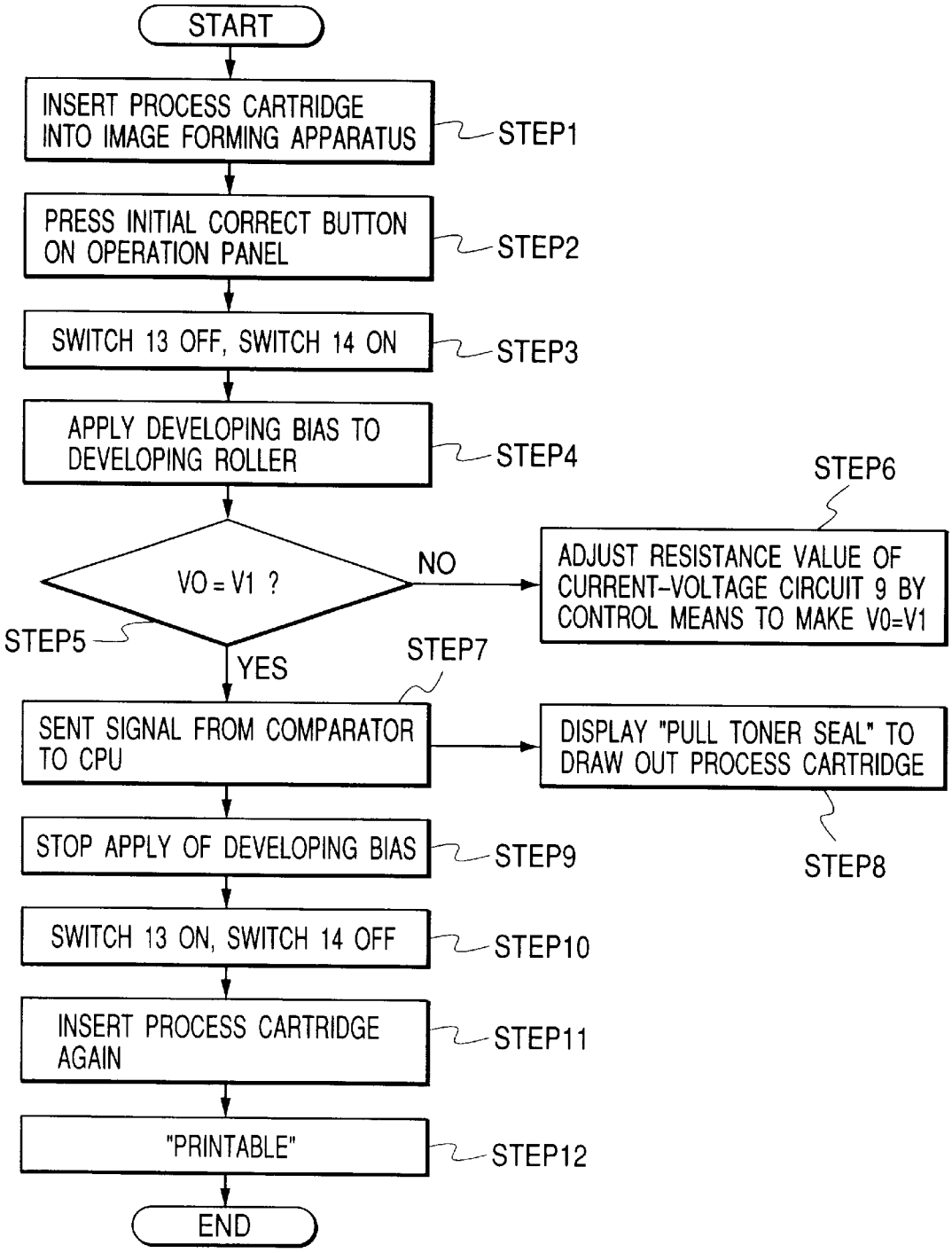
FIG. 4 is a flow chart showing a developing agent amount detecting method of the developing agent amount detecting device according to the first embodiment.

Next, a method for detecting a remaining amount of the developing agent according to the illustrated embodiment will be explained with reference to FIG. 1 and FIG. 4 (flow chart).

An important characteristic according to the illustrated embodiment is that the output voltage V0 in a condition that the developing agent 2 does not exist between the developing roller 6 and the developing agent remaining amount detecting member 1 is previously corrected before the process cartridge 100 is used (this correction is referred to as "initial correction" hereinafter).

As shown in FIG. 2, the developing agent seal member 20 is adhered, at the opening portion 21, to the developing container 3 of anew process cartridge 100 which is not yet used. First of all, the operator inserts the process cartridge 100 into the main body of the image forming apparatus before the developing agent seal member 20 is removed (step 1). Then, an initial correction button on an operation panel provided on a front surface of the main body is depressed (step 2). As a result, the first switch 14 in the developing agent remaining amount detecting circuit 40 is closed and the second switch 13 is opened (step 3).

Then, developing bias is applied from the alternate current power source 7 to the developing roller 6 (step 4). In this case, the output voltage V0 based on the current generated in the developing agent remaining amount detecting member 1 is compared with a previously set initial correction value V1 by the first comparator 16 (step 5). If these values do not coincide with each other, the variable resistance of the first current-voltage convert circuit 9 is adjusted by the control means 12 (step 6), and the adjusted output value V0 is inputted to the first comparator 16 again. This process is repeated until the output value V0 coincides with the initial correction value V1. In this case, the developing bias continues to be applied to the developing roller 6. When the output value V0 coincides with the initial correction value V1, the signal is sent from the comparator 16 to the CPU 18 (step 7).

As a result, the display of the words "draw out process cartridge from image forming apparatus; after removal of developing agent seal member, mount process cartridge to apparatus again" is effected (step 8). In this case, the application of the developing bias is stopped (step 9), and the first switch 14 is opened and the second switch 13 is closed (step 10).

Then, the operator draws out the process cartridge 100 from the main body, then removes the developing agent seal member 20 and then inserts the process cartridge 100 into the main body again (step 11). At this point, the image forming apparatus 200 enters a printable condition (step 12), and, thus, the desired image can be obtained.

Whenever image formation is effected, the voltage Vdc outputted on the basis of the electrostatic capacity changed in accordance with the amount of the developing agent existing between the developing roller 6 and the developing agent remaining amount detecting member 1 can be compared with the output voltage Vth from the second current-voltage convert circuit 11 by the comparator 15. As image formation is continued to gradually decrease the remaining amount of the developing agent in the developing container 3, if the output voltage Vdc coincides with the output voltage Vth, the signal is sent to the CPU 18. As a result, the fact that the remaining amount of the developing agent becomes small is displayed on the display panel of the image forming apparatus 200.

Figure 5:
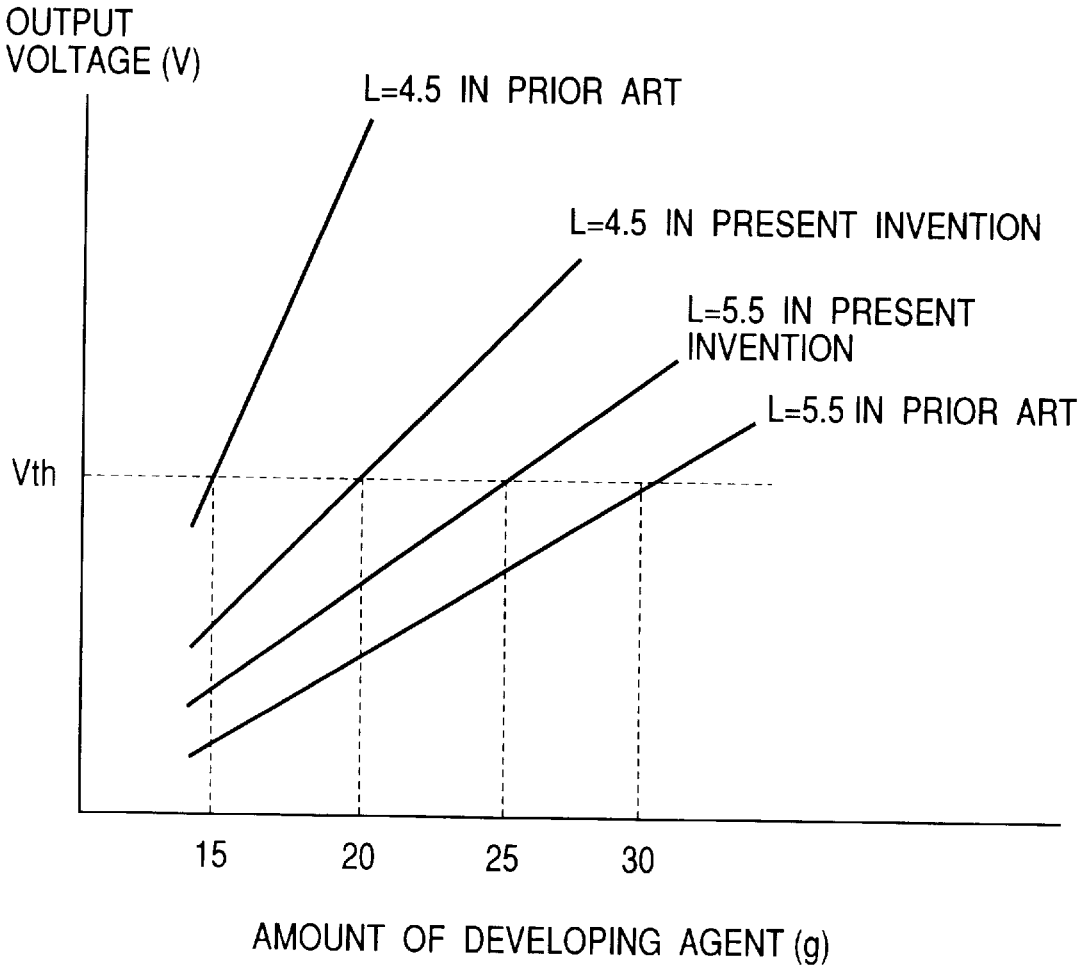
FIG. 5 is a graph showing a comparison between the output voltage of the developing agent amount detecting device according to the first embodiment and the output voltage in a conventional developing agent amount detecting technique.

A result of a test performed to ascertain the effect of the invention according to the illustrated embodiment is shown in FIG. 5.

FIG. 5 shows the relation between the remaining amount of the developing agent and the output voltage Vdc when that the developing roller 6 is spaced apart from the developing agent remaining amount detecting member 1 by the distance L, regarding the developing agent remaining amount detecting methods according to the present invention and according to the prior art. Although the amount of the developing agent is set to 300 grams when the process cartridge is supplied from the factory, in the graph shown in FIG. 5, only the conditions near the set voltage Vth are illustrated. A maximum value of the distance L was set to 5.5 mm and a minimum value of the distance L was set to 4.5 mm.

According to the test result, in the prior art, due to the tolerance of distance between the developing roller 6 and the developing agent remaining amount detecting member 1, when the output voltage level Vth (warning the user of the fact that the amount of the developing agent is small) de reached, the amount of the developing agent was within a range of 15 to 30 grams. To the contrary, by applying the present invention, the range was changed to 20 to 25 grams to reduce unevenness in comparison with the prior art.

As mentioned above, in the illustrated embodiment, there is provided a mechanism for adjusting the developing agent remaining amount detecting signal to the predetermined value at the point that the developing agent does not exist between the developing roller and the developing agent remaining amount detecting member. Thus, according to the illustrated embodiment, since the influences on the positioning accuracy of the developing agent remaining amount detecting member are reduced and unevenness in a property value, such as resistance of the developing agent remaining amount detecting circuit is redused, a developing agent remaining amount detecting device having high accurate detecting ability can be provided.

In the illustrated embodiment, while an example that the developing agent remaining amount detecting device is of electrostatic capacity type was explained, the present invention is not limited to such an embodiment, so long as a detection signal can be detected under a condition that the influence of the developing agent is not affected, a developing agent remaining amount detecting device of an optical detecting type or a magnet sensor type can be used, as well as the electrostatic capacity type.

(Second Embodiment)

Figure 6:
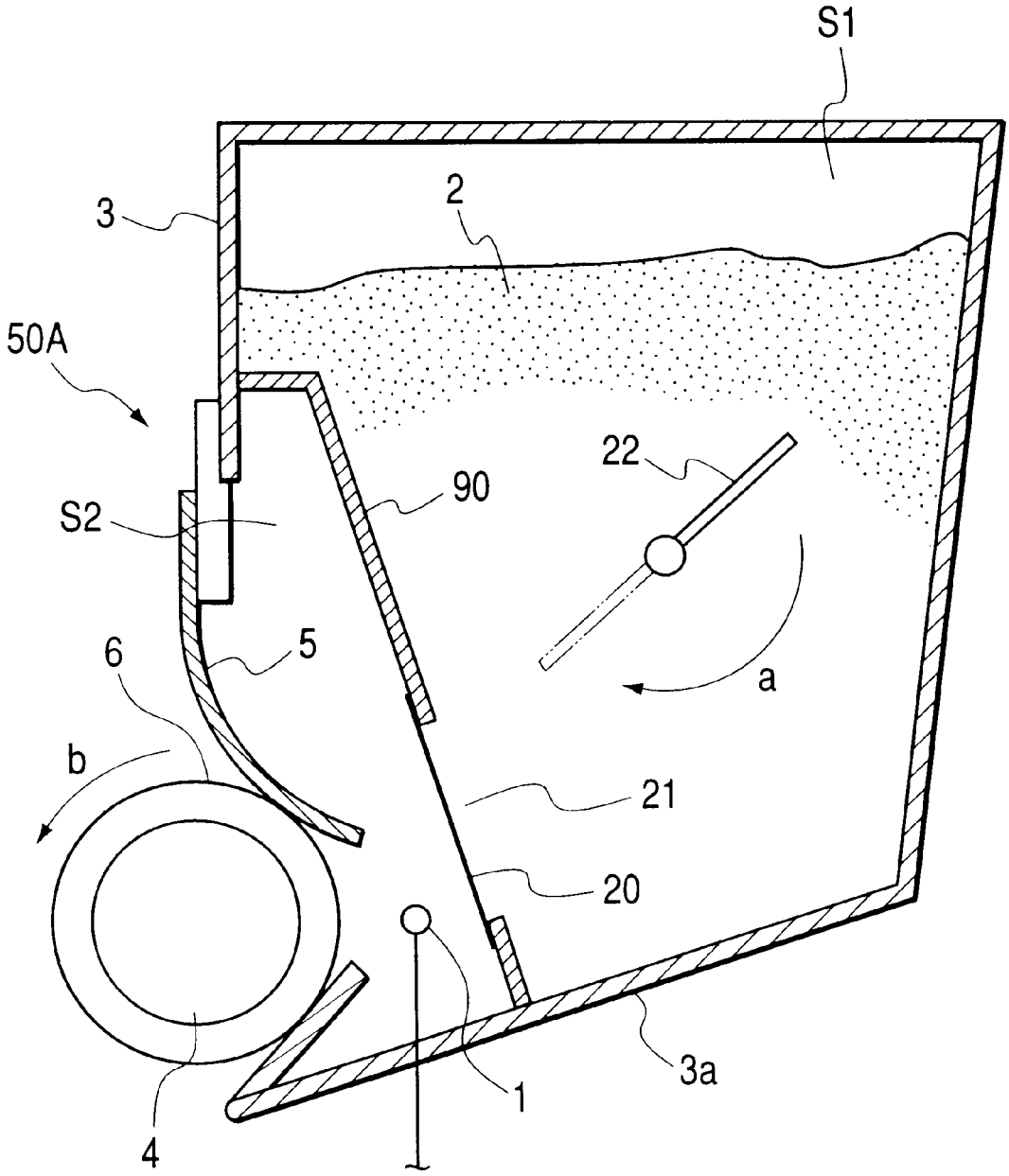
FIG. 6 is a sectional view of a developing device according to a second embodiment of the present invention.

FIG. 6 shows a developing device 50A of cartridge type according to a second embodiment of the present invention.

In the developing device 50A according to this embodiment, a developing agent bearing member 6 (such as a developing roller) and a developing means having a developing agent container 3 for containing developing agent (toner) to be supplied to the developing agent bearing member 6 are integrally incorporated into a plastic frame 3*a* to form a cartridge. That is to say, the developing device 50A according to the illustrated embodiment can be considered as a cartridge obtained by removing the photosensitive drum 30 from the process cartridge 100 according to the first embodiment. Accordingly, the constructions and functions of the toner containing portion 3, the developing agent remaining amount detecting member 1 and the like are the same as those in the first embodiment. Thus, the elements having the same construction and function as those in the first embodiment are designated by the same reference numerals, and an explanation thereof will be omitted.

(Third Embodiment)

Next, a third embodiment of the present invention will be explained with reference to FIGS. 7 and 8. The characteristic of the third embodiment is that the developing agent seal member is not removed by the operator but is automatically shifted after the initial correction. Since the other aspects are the same as those of the first embodiment, explanation thereof will be omitted.

Figure 7:
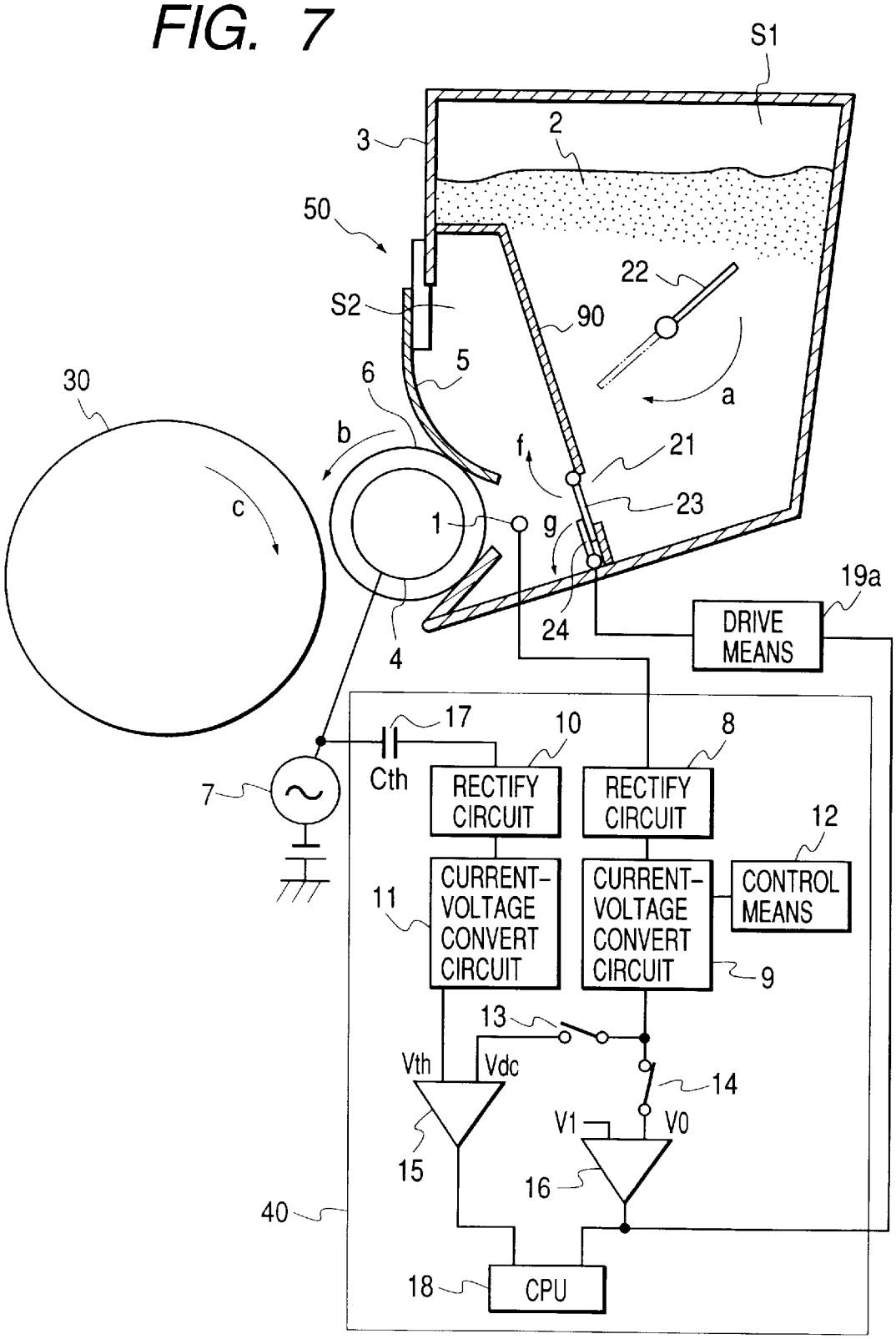
FIG. 7 is a constructural view of a developing agent amount detecting device according to a third embodiment of the present invention.
Figure 8:
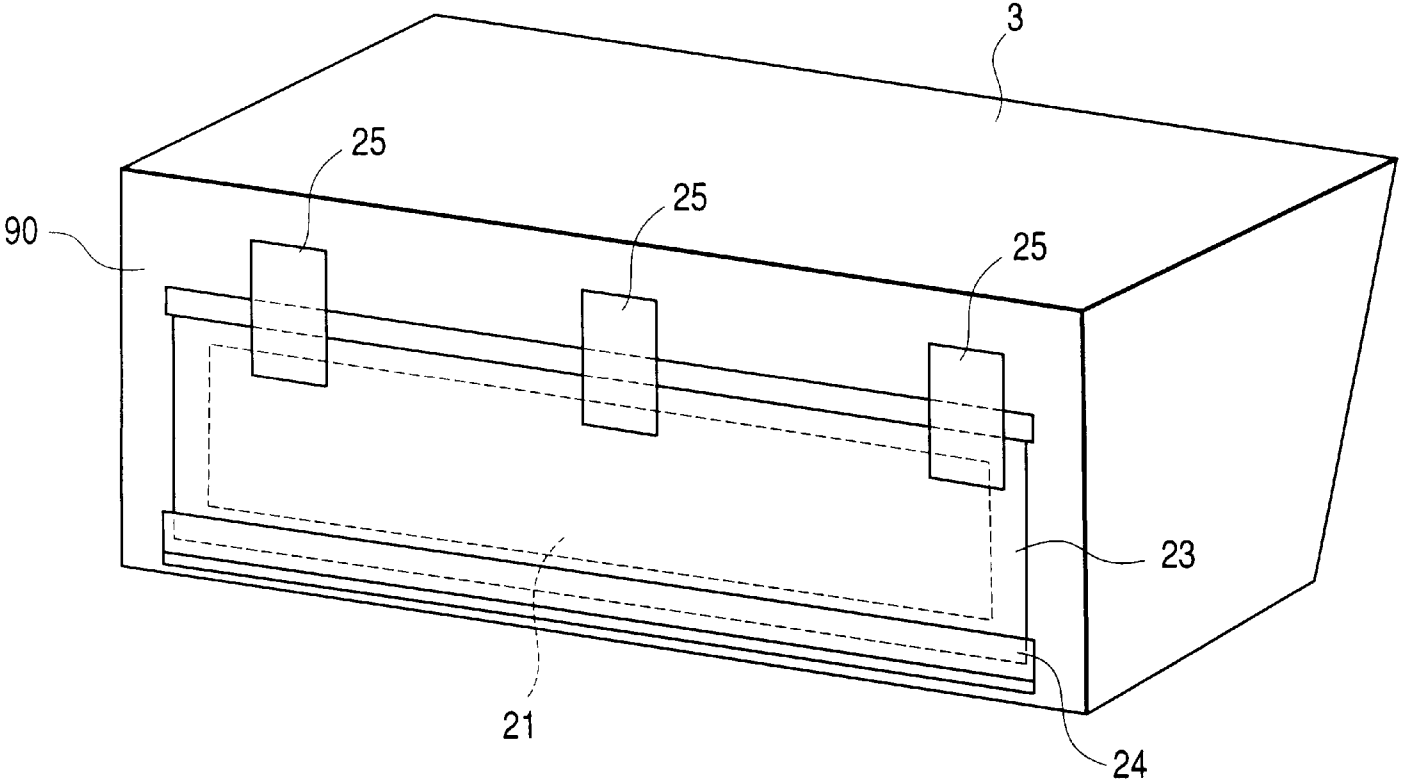
FIG. 8 is a perspective view showing a developing agent seal member of a developing container according to the third embodiment.

As shown in FIG. 7, during the manufacture of the process cartridge, the interior of the developing container 3 is divided, by a partition plate 90 and a developing agent seal member 23, into a space S1 in which the developing agent 2 is existed and a space S2 in which the developing agent 2 does not exist. As shown in FIG. 8, an opening portion 21 adapted to supply the developing agent and having a width W1 of 30 mm and a length W2 of 220 mm is formed in the partition plate 90 is flush with the partition plate.

During the manufacture of the process cartridge, a shutter (as the developing agent seal member) 23 is provided on the opening portion 21. The shutter 23 has spring-biased hinges 25 for opening the shutter in a direction shown by the arrow f, which hinges are disposed at upper end of the opening portion 21 along a longitudinal direction thereof. The restoring forces of the hinges 25 act toward a direction for opening the shutter 23 in the direction f. Further, a stopper 24 for preventing the shutter from being opened until the initial correction is finished is provided on a lower end of the opening portion 21 along the longitudinal direction thereof. The stopper 24 is connected to a drive means 19*a*, and the drive means 19*a* is connected to an output side of the first comparator 16.

With the arrangement as mentioned above, when the initial correction is finished, a signal is sent from the first comparator 16 to the drive means 19*a*, with the result that the stopper 24 is opened in a direction shown by the arrow g, thereby opening the shutter 23 in the direction f by the restoring forces of the hinges 25. When the shutter 23 is opened, the developing agent 2 passes through the opening portion 21 to reach the developing roller 6 and the elastic blade 5 and is born on the developing roller 6 to be used in image formation.

Since the developing agent remaining amount detecting circuit 40 according to the illustrated embodiment is the same as that in the first embodiment except that the first comparator 16 is connected to the drive means 19*a*, explanation thereof will be omitted.

Figure 9:
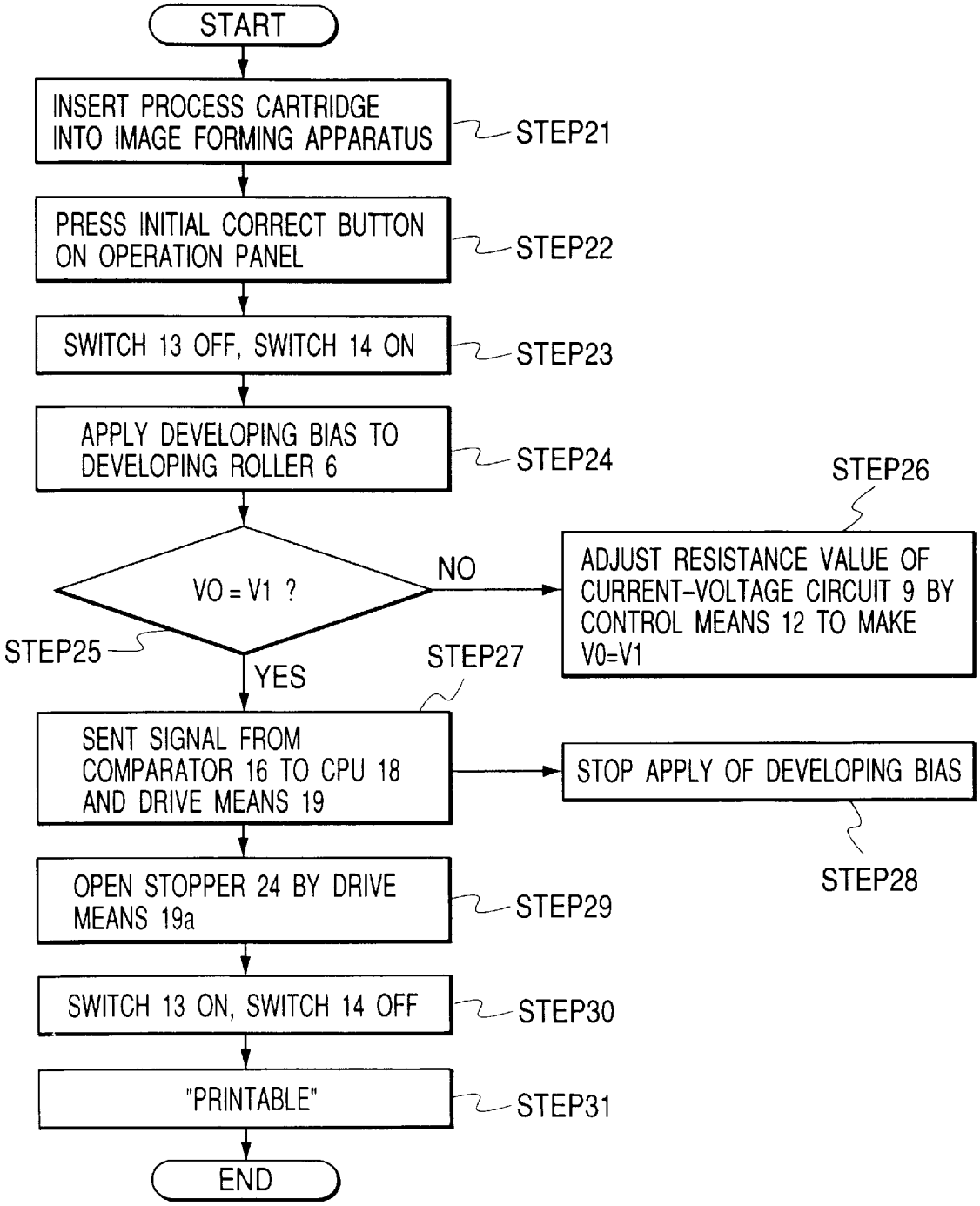
FIG. 9 is a flow chart showing a developing agent amount detecting method of the developing agent amount detecting device according to the third embodiment.

Next, a method for detecting a remaining amount of the developing agent according to the illustrated embodiment will be explained with reference to a flow chart shown in FIG. 9.

First of all, the operator inserts the process cartridge 100 into the main body of the image forming apparatus (step 21). Then, an initial correction button on an operation panel provided on a front surface of the main body is depressed (step 22). As a result, the first switch 14 in the developing agent remaining amount detecting circuit 40 is closed and the second switch 13 is opened (step 23). Then, a developing bias is applied to the developing roller 6 (step 24).

In this case, the output voltage V0 based on the current generated in the developing agent remaining amount detecting member 1 is compared with a previously set initial correction value V1 by the first comparator 16 (step 25). If these values do not coincide with each other, the variable resistance of the first current-voltage convert circuit 9 is adjusted by the control means 12 (step 26), and the adjusted output value V0 is inputted to the first comparator 16 again. This process is repeated until the output value V0 coincides with the initial correction value V1. In this case, the developing bias continues to be applied to the developing roller 6.

When the output value V0 coincides with the initial correction value V1, the signal is sent from the comparator 16 to the CPU 18 and the drive means 19*a* (step 27), and the application of the developing bias is stopped (step 28). As a result, the stopper 24 provided at the opening portion 21 is opened by the drive means 19*a* to open the shutter 23 (step 29). The first switch 14 is opened and the second switch 13 is closed (step 30). At this point, the image forming apparatus assumes a printable condition (step 31), and, thus, the desired image can be obtained.

Whenever image formation is effected, the voltage Vdc outputted on the basis of the electrostatic capacity changed in accordance with the amount of the developing agent existed between the developing roller 6 and the developing agent remaining amount detecting member 1 can be compared with the output voltage Vth from the second current-voltage convert circuit 11 by the comparator 15. As the image formation is continued to gradually decrease the remained amount of the developing agent in the developing container 3, if the output voltage Vdc coincides with the output voltage Vth, the signal is sent to the CPU 18. As a result, the fact that the remained amount of the developing agent becomes small is displayed on the display panel of the image forming apparatus.

As mentioned above, in the illustrated embodiment, there is provided a mechanism for adjusting the developing agent remaining amount detecting signal to the predetermined value at the point that the developing agent does not exist between the developing roller and the developing agent remaining amount detecting member, and a mechanism for automatically opening the developing agent seal member 20. Thus, according to the illustrated embodiment, since the influences on the positioning accuracy of the developing agent remaining amount detecting member are reduced and unevenness in a property value, such as resistance of the developing agent remaining amount detecting circuit is reduced, the developing agent remaining amount detecting device having high accurate detecting ability can be provided.

Further, in this embodiment, since the mechanism for automatically opening the opening portion of the developing container is provided, the operator's erroneous operation can be prevented, and a developing agent remaining amount detecting device having excellent usability can be provided.

(Fourth Embodiment)

Figure 10:
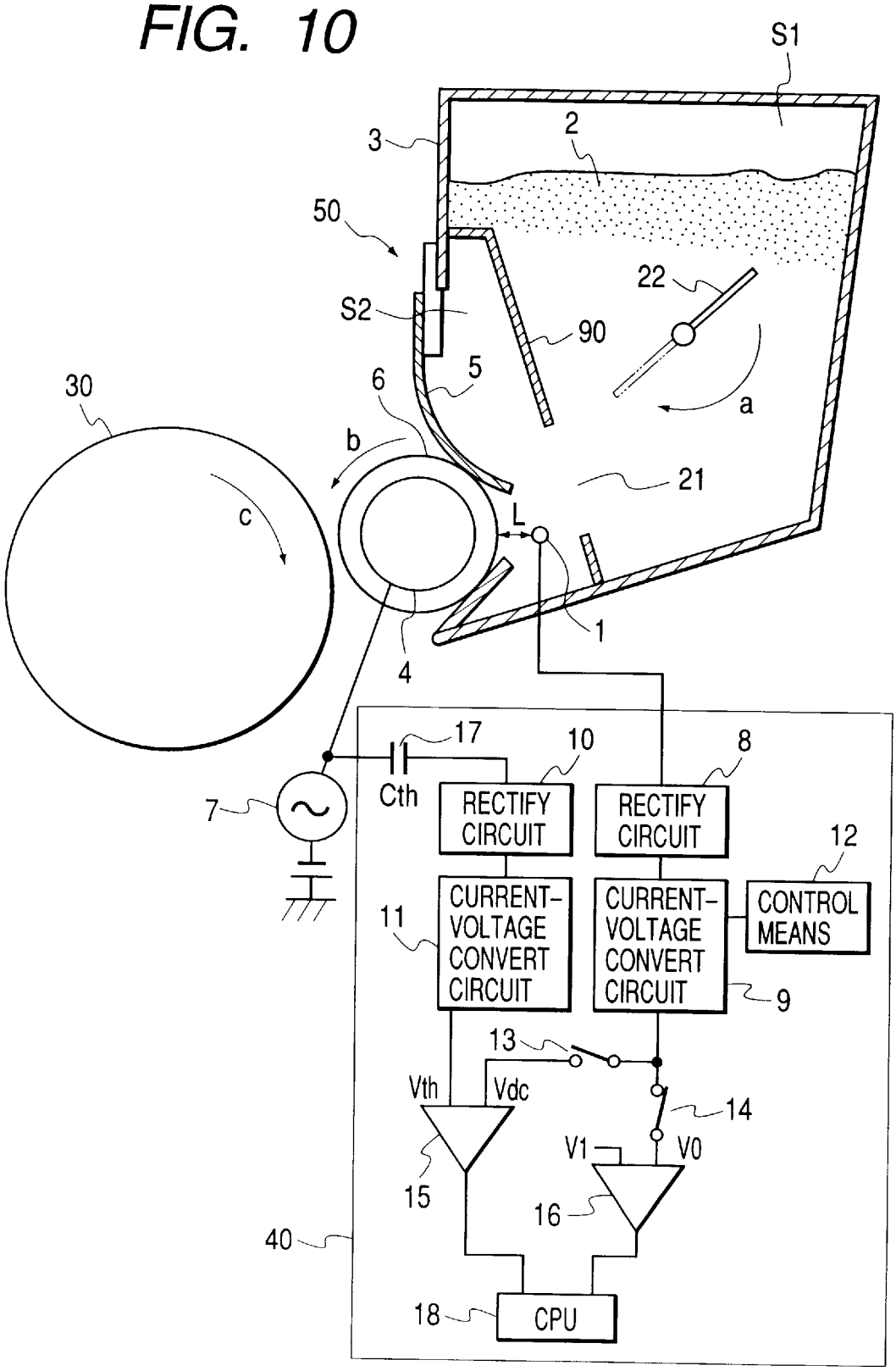
FIG. 10 is a constructural view of a developing agent amount detecting device according to a fourth embodiment of the present invention.

Next, a fourth embodiment of the present invention will be explained with reference to FIG. 10. The characteristic of the fourth embodiment is that, prior to image formation, the initial correction is effected when that the developing agent seal member 20 is removed.

Figure 11:
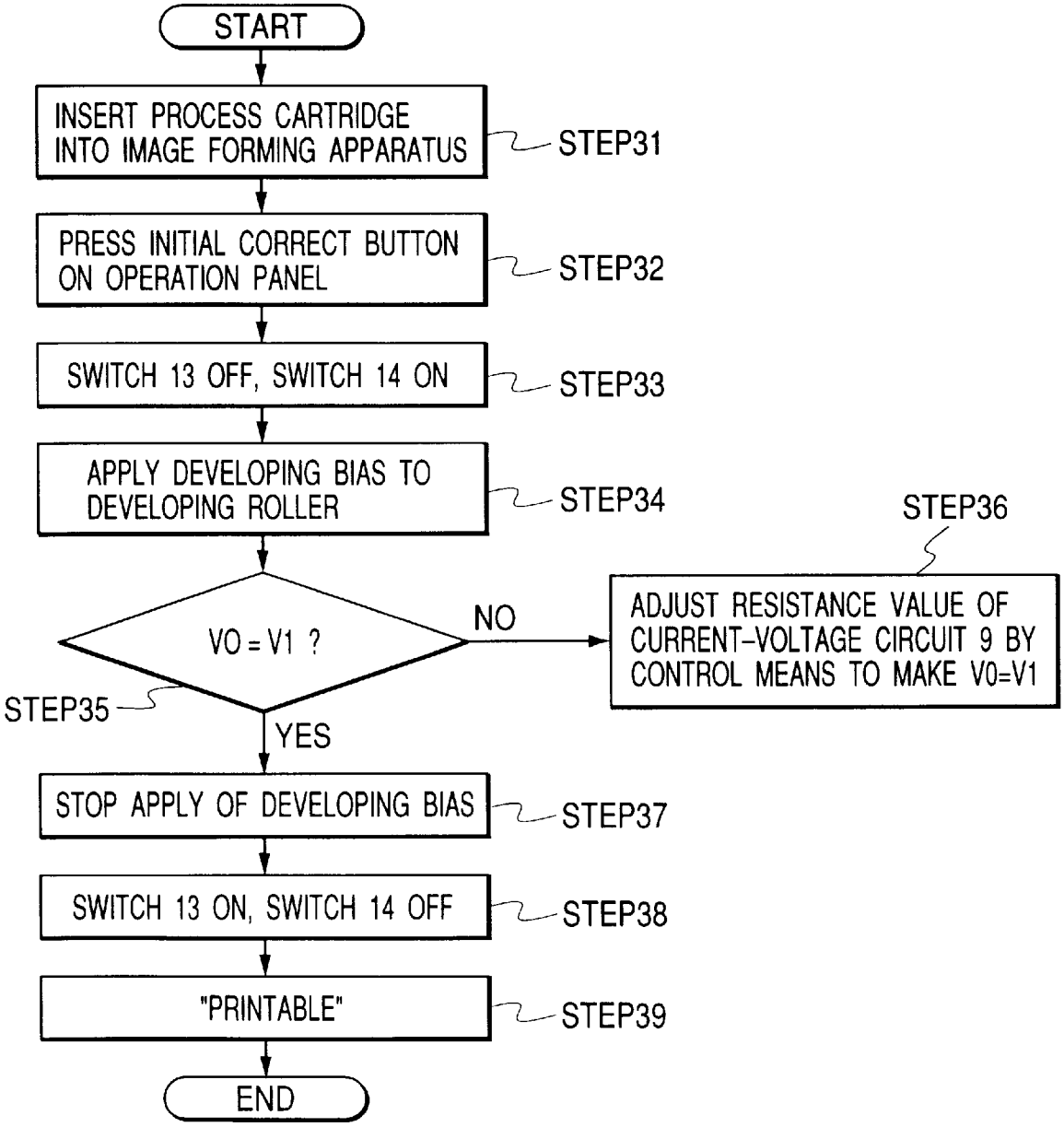
FIG. 11 is a flow chart showing a developing agent amount detecting method of the developing agent amount detecting device according to the fourth embodiment.

Next, a developing agent remaining amount detecting method according to the fourth embodiment will be explained with reference to a flow chart shown in FIG. 11.

First of all, the operator removes the developing agent seal member 20, and, after the process cartridge 100 is shaken appropriately, the operator inserts the process cartridge 100 into the main body of the image forming apparatus (step 31). Then, an initial correction button on an operation panel provided on a front surface of the main body is depressed (step 32). As a result, the first switch 14 in the developing agent remaining amount detecting circuit 40 is closed and the second switch 13 is opened (step 33). Then, developing bias is applied to the developing roller 6 (step 34).

In this case, the output voltage V0 based on the current generated in the developing agent remaining amount detecting member 1 is compared with a previously set initial correction value V1 by the first comparator 16 (step 35). If these values do not coincide with each other, the variable resistance of the first current-voltage convert circuit 9 is adjusted by the control means 12 (step 36), and the adjusted output value V0 is inputted to the first comparator 16 again. This process is repeated until the output value V0 coincides with the initial correction value V1. In this case, the developing bias continues to be applied to the developing roller 6.

When the output value V0 coincides with the initial correction value V1, the application of the developing bias is stopped (step 37). The first switch 14 is opened and the second switch 13 is closed (step 38). At this point, the image forming apparatus assumes a printable condition (step 39), and, thus, the desired image can be obtained.

Whenever image formation is effected, the voltage Vdc outputted on the basis of the electrostatic capacity changed in accordance with the amount of the developing agent existing between the developing roller 6 and the developing agent remaining amount detecting member 1 can be compared with the output voltage Vth from the second current-voltage convert circuit 11 by the comparator 15. As image formation is continued to gradually decrease the remaining amount of the developing agent in the developing container 3, if the output voltage Vdc coincides with the output voltage Vth, the signal is sent to the CPU 18. As a result, the fact that the remaining amount of the developing agent becomes small is displayed on the display panel of the image forming apparatus.

(Fifth Embodiment)

Figure 12:
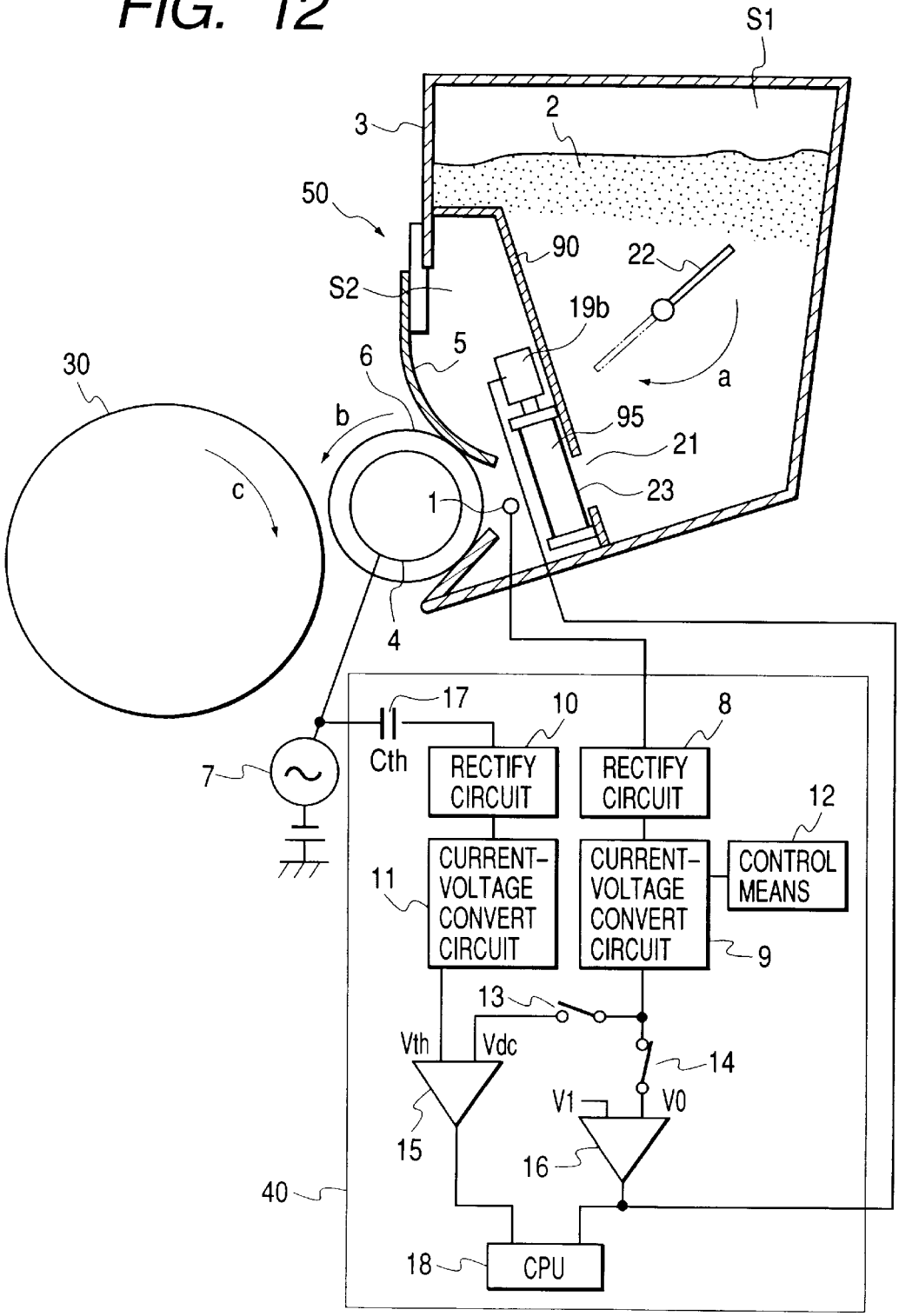
FIG. 12 is a constructural view of a developing agent amount detecting device according to a fifth embodiment of the present invention.
Figure 13:
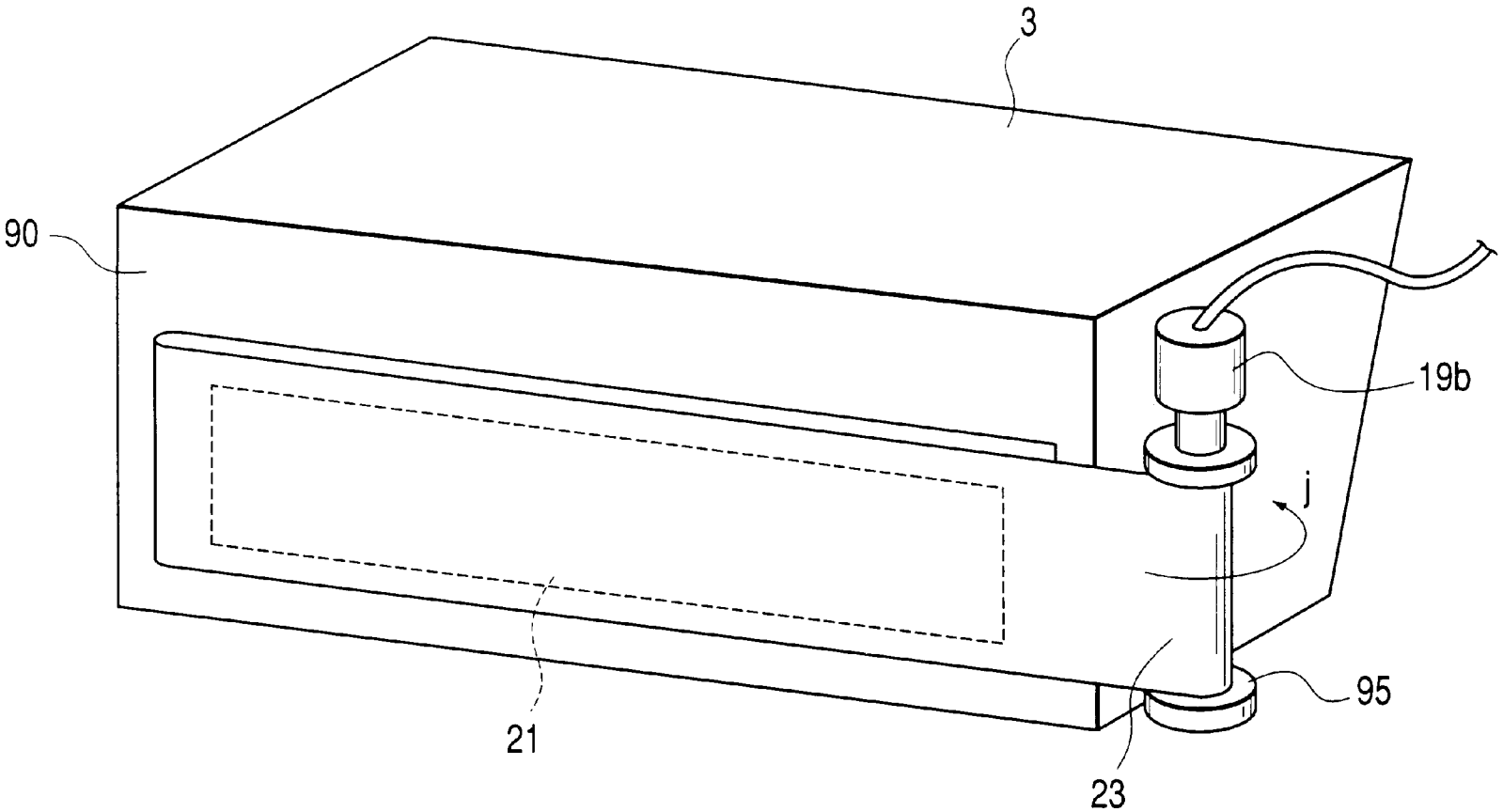
FIG. 13 is a perspective view of a developing unit according to the fifth embodiment.

Next, a fifth embodiment of the present invention will be explained with reference to FIGS. 12 and 13. The characteristic of this embodiment is that, similar to the third embodiment, the developing agent seal member is not removed by the operator but is automatically shifted after the initial correction. Since the other aspects are the same as those of the first embodiment, an explanation thereof will be omitted.

In this embodiment, a developing agent seal member 23 is adhered to cover the opening portion 21. The developing agent seal member 23 is folded after it covers the opening portion 21 and extends toward a wind shaft 95. One end of the developing agent seal member 23 is secured to the wind shaft 95. When the wind shaft 95 is rotated by a drive means 19*b* such as a motor, the developing agent seal member 23 is wound around the wind shaft to open or unseal the opening portion 21. Incidentally, the drive means 19*b* is connected to an output side of the first comparator 16.

With the arrangement as mentioned above, when the initial correction is finished, a signal is sent from the first comparator 16 to the drive means 19*b*, with the result that the wind shaft 95 is rotated in a direction shown by the arrow j. Consequently, the developing agent seal member 23 is wound up to open the opening portion 21. The developing agent 2 passes through the opening portion 21 to reach the developing roller 6 and the elastic blade 5 and is born on the developing roller 6 to be used in image formation.

Since the developing agent remaining amount detecting circuit 40 according to the illustrated embodiment is the same as that in the first embodiment except that the first comparator 16 is connected to the drive means 19*b*, an explanation thereof will be omitted.

Figure 14:
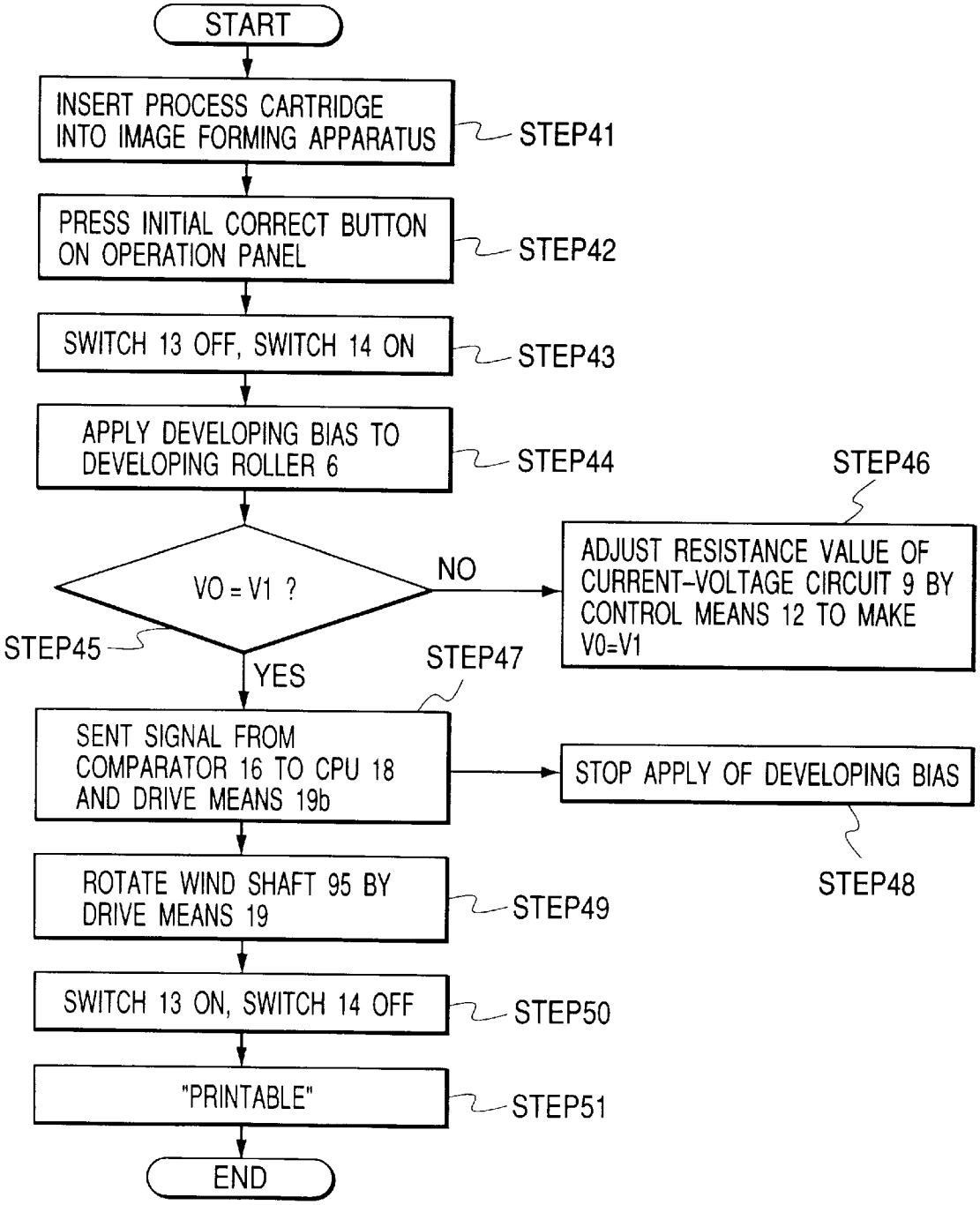
FIG. 14 is a flow chart showing a developing agent amount detecting method of the developing agent amount detecting device according to the fifth embodiment.

Next, a method for detecting a remaining amount of the developing agent according to the illustrated embodiment will be explained with reference to a flow chart shown in FIG. 14.

First of all, the operator inserts the process cartridge 100 into the main body of the image forming apparatus (step 41). Then, an initial correction button on an operation panel provided on a front surface of the main body is depressed (step 42). As a result, the first switch 14 in the developing agent remaining amount detecting circuit 40 is closed and the second switch 13 is opened (step 43). Then, developing bias is applied to the developing roller 6 (step 44).

In this case, the output voltage V0 based on the current generated in the developing agent remaining amount detecting member 1 is compared with a previously set initial correction value V1 by the first comparator 16 (step 45). If these value do not coincide with each other, the variable resistance of the first current-voltage convert circuit 9 is adjusted by the control means 12 (step 46), and the adjusted output value V0 is inputted to the first comparator 16 again. This process is repeated until the output value V0 coincides with initial correction value V1. In this case, the developing bias continues to be applied to the developing roller 6.

When the output value V0 coincides with the initial correction value V1, the signal is sent from the comparator 16 to the CPU 18 and the drive means 19*b* (step 47), and the application of the developing bias is stopped (step 48). As a result, the wind shaft 95 is rotated to remove the developing agent seal member (step 49). The first switch 14 is opened and the second switch 13 is closed (step 50). At this point, the image forming apparatus assumes a printable condition (step 51), and, thus, the desired image can be obtained.

Whenever image formation is effected, the voltage Vdc outputted on the basis of the electrostatic capacity changed in accordance with the amount of the developing agent existed between the developing roller 6 and the developing agent remaining amount detecting member 1 can be compared with the output voltage Vth from the second current-voltage convert circuit 11 by the comparator 15. As image formation is continued to gradually decrease the remaining amount of the developing agent in the developing container 3, if the output voltage Vdc coincides with the output voltage Vth, the signal is sent to the CPU 18. As a result, the fact that the remaining amount of the developing aagent becomes small is displayed on the display panel of the image forming apparatus.

As mentioned above, in the illustrated embodiment, there are provided a mechanism for adjusting the developing agent remaining amount detecting signal to the predetermined value at the point that the developing agent does not exist between the developing roller and the developing agent remaining amount detecting member, and a mechanism for automatically opening the developing agent seal member 23. Thus, according to the illustrated embodiment, since influences on the positioning accuracy of the developing agent remaining amount detecting member are reduced and unevenness in a property value such as resistance of the developing agent remaining amount detecting circuit is reduced, the developing agent remaining amount detecting device having high accurate detecting ability can be provided.

Further, in this embodiment, since the mechanism for automatically opening the opening portion of the developing container is provided, the operator's erroneous operation can be prevented, and a developing agent remaining amount detecting device having excellent usability can be provided.

(Sixth Embodiment)

Figure 15:
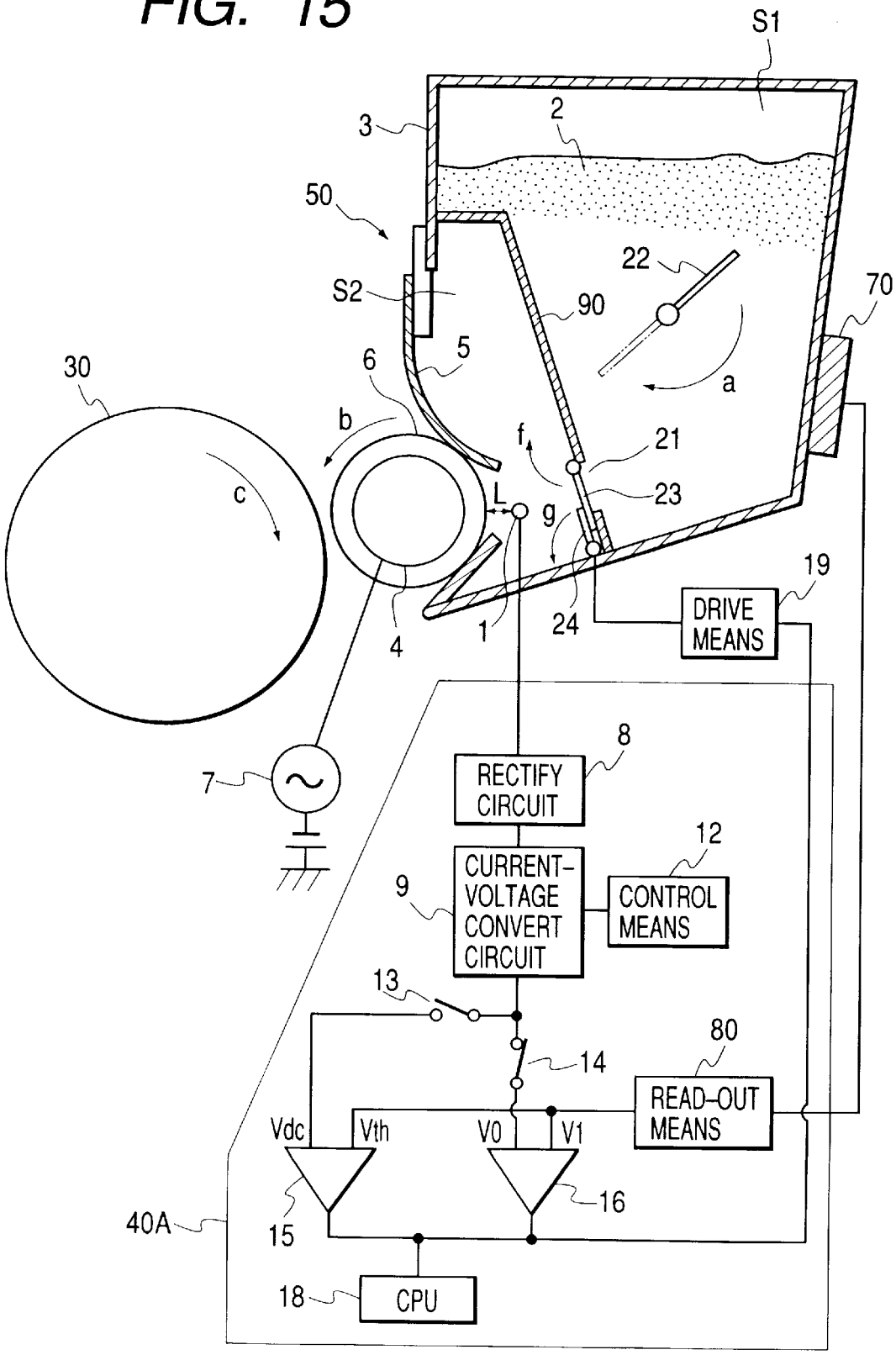
FIG. 15 is a constructural view of a developing agent amount detecting device according to a sixth embodiment of the present invention.
Figure 16:
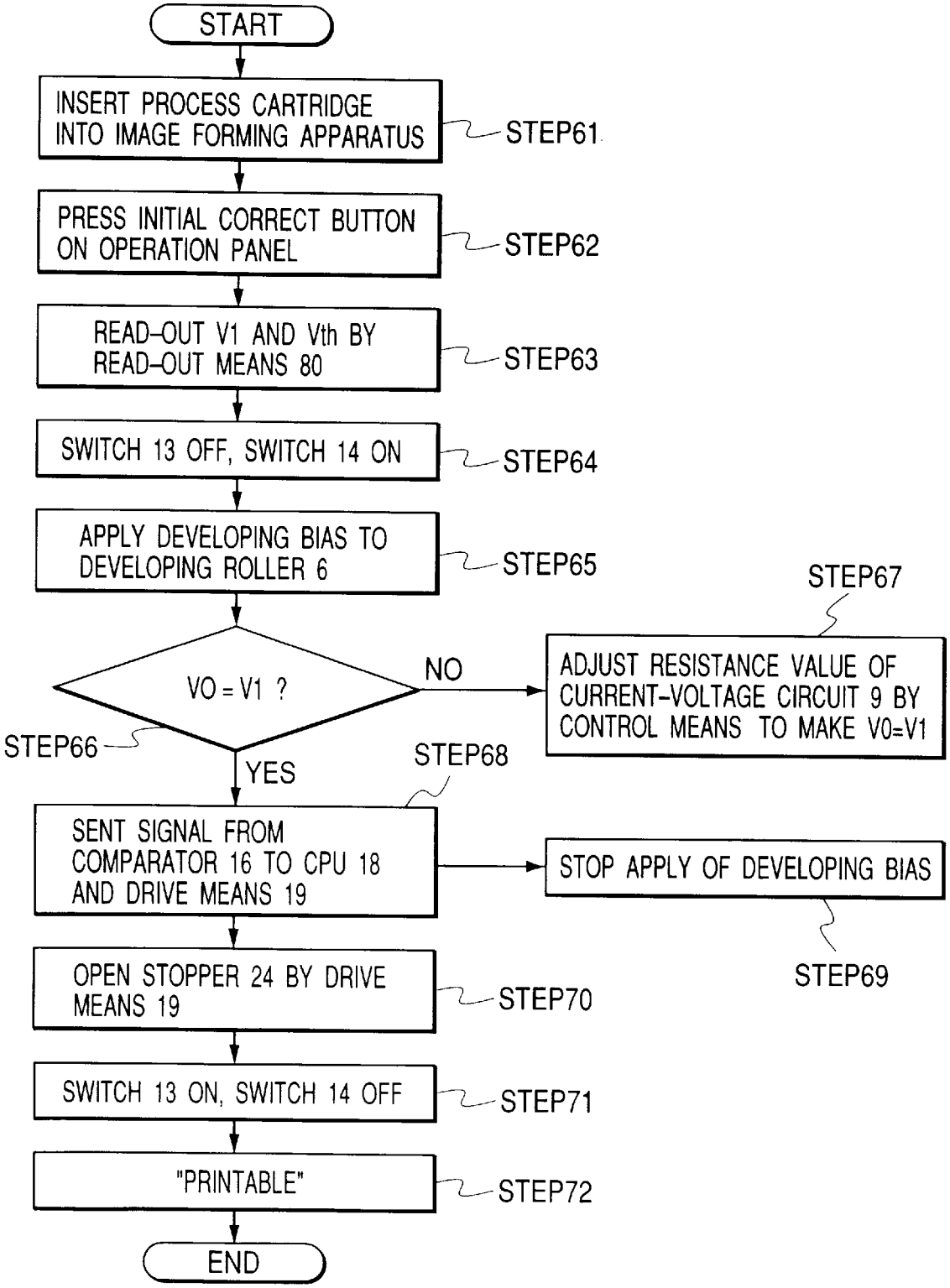
FIG. 16 is a flow chart showing a developing agent amount detecting method of the developing agent amount detecting device according to the sixth embodiment.

Next, a sixth embodiment of the present invention will be explained with reference to FIGS. 15 and 16.

The characteristic of this embodiment is that the initial correction value V1 is stored in a memory element 70 provided in the developing device or a process cartridge including such a developing device, in place of the image forming apparatus.

Now, a construction of the developing agent remaining amount detecting device according to this embodiment will be described with reference to FIG. 15.

The process cartridge is provided with a memory element 70, and a developing agent remained amount detecting member 1. During the manufacture of the process cartridge, an initial correction value V1 as a reference for a developing agent remaining amount detection signal, and a set voltage value Vth as a reference for informing the operator of the fact that the remaining amount of the developing agent becomes small are stored in the memory element 70.

The initial correction value V1 depends upon a distance L between the developing roller 6 and the developing agent remaining amount detecting member 1, and, the greater the distance L the smaller the initial correction value V1 to be set. The setting of the initial correction value is performed when the process cartridge 100 is manufactured. More specifically, a developing agent remaining amount detecting circuit in which the accuracy of the electrical property thereof is to be more severe than the margin of the manufacture of the process cartridge is used, and a developing bias wave form, in which the accuracy is severely controlled, is applied to the developing roller 6, and, an output voltage value detected in this case is stored in the memory element 70 as the initial correction value V1.

The set voltage value Vth is considered and determined, at the designing of the process cartridge, on the basis of the distance L and the initial correction value V1 to effect the good developing agent remaining amount detection.

The image forming apparatus 200 is provided with a read-out means 80 for reading out the initial correction value V1 and the set voltage value Vth stored in the memory element 70. The read-out initial correction value V1 and set voltage value Vth are sent to the comparators 16, 15, respectively. The developing agent remaining amount detecting member 1 is connected to a developing agent remaining amount detecting circuit 40A provided in the image forming apparatus 200.

The developing agent remaining amount detecting circuit 40A includes a rectify circuit 8 and a current-voltage convert circuit 9 connected to the developing agent remaining amount detecting member 1 in series, and a first comparator 16 for comparing the voltage value V0 outputted from the current-voltage convert circuit 9 with the initial correction value V1 read out from the memory element 70 and for emitting a signal when these values coincide with each other. The detecting circuit 40A further includes a first switch 14 disposed between the current-voltage convert circuit 9 and the first comparator 16, a second comparator 15 for comparing the voltage value Vdc outputted from the current-voltage convert circuit 9 with the set voltage value Vth read out from the memory element 70 and for emitting a signal when these values coincide with each other, a second switch 13 disposed between the current-voltage convert circuit 9 and the second comparator 13, and a CPU 18 for detecting a signal emitted from the second comparator 15. The CPU 18 serves to effect treatment, such as displaying a warning of the developing agent remaining amount on the basis of the detected signals.

Next, a method for detecting the developing agent remaining amount according to the illustrated embodiment will be explained with reference to a flow chart shown in FIG. 16.

First of all, the operator inserts the process cartridge 100 into the main body of the image forming apparatus (step 61). Then, an initial correction button on an operation panel provided on a front surface of the main body is depressed (step 62). As a result, the initial correction value V1 and the set voltage value Vth are read out from the memory element 70 (step 63), and the first switch 14 in the developing agent remaining amount detecting circuit 40 is closed and the second switch 13 is opened (step 64). Then, developing bias is applied to the developing roller 6 (step 65).

In this case, the output voltage V0 based on the current generated in the developing agent remaining amount detecting member 1 is compared with the initial correction value V1 read out from the memory element 70 by the first comparator 16 (step 66). If these values do not coincide with each other, the variable resistance of the first current-voltage convert circuit 9 is adjusted by the control means 12 (step 67), and the adjusted output value V0 is inputted to the first comparator 16 again. This process is repeated until the output value V0 coincides with the initial correction value V1. In this case, the developing bias continues to be applied to the developing roller 6.

When the output value V0 coincides with the initial correction value V1, the signal is sent from the comparator 16 to the CPU 18 and the drive means 19 (step 68), and the application of the developing bias is stopped (step 69). As a result, the shutter 23 provided at the opening portion 21 is opened (step 70). In this case, the first switch 14 is opened and the second switch 13 is closed (step 71). At this point, the image forming apparatus assumes a printable condition (step 72), and, thus, the desired image can be obtained.

Whenever image formation is effected, the voltage Vdc, outputted on the basis of the electrostatic capacity changed in accordance with the amount of the developing agent existing between the developing roller 6 and the developing agent remaining amount detecting member 1 can be compared with the set voltage value Vth read out from the memory element 70 by the comparator 15. Whenever image formation is effected, the set voltage value Vth is read out from the memory element 70. As image formation is continued to gradually decrease the remaining amount of the developing agent in the developing container 3, if the output voltage Vdc coincides with the set voltage value Vth, the signal is sent to the CPU 18. As a result, the fact that the remaining amount of the developing agent becomes small is displayed on the display panel of the image forming apparatus.

As mentioned above, in the illustrated embodiment, there are provided a mechanism for adjusting the developing agent remaining amount detecting signal to the value depending upon the distance L between the developing roller 6 and the developing agent remaining amount detecting member 1 at the podevelopt the developing agent does not exist between the developing roller and the developing agent remaining amount detecting member, and a mechanism for automatically opening the developing agent seal member.

Thus, according to the illustrated embodiment, since the influences on the positioning accuracy of the developing agent remaining amount detecting member are reduced and unevenness in the property value, such as resistance of the developing agent remaining amount detecting circuit is reduced, the developing agent remaining amount detecting device having high accurate detecting ability can be provided. Further, since the set value as the reference for the initial correction is selected as a value depending upon the distance between the developing roller and the developing agent remaining amount detecting member, the corresponding set voltage value Vth can be previously set, thereby improving detecting accuracy. Further, in this embodiment, since the mechanism for automatically opening the opening portion of the developing container, the operator's erroneous operation can be prevented, and a developing agent remaining amount detecting device having excellent usability can be provided.

(Seventh Embodiment)

Figure 17:
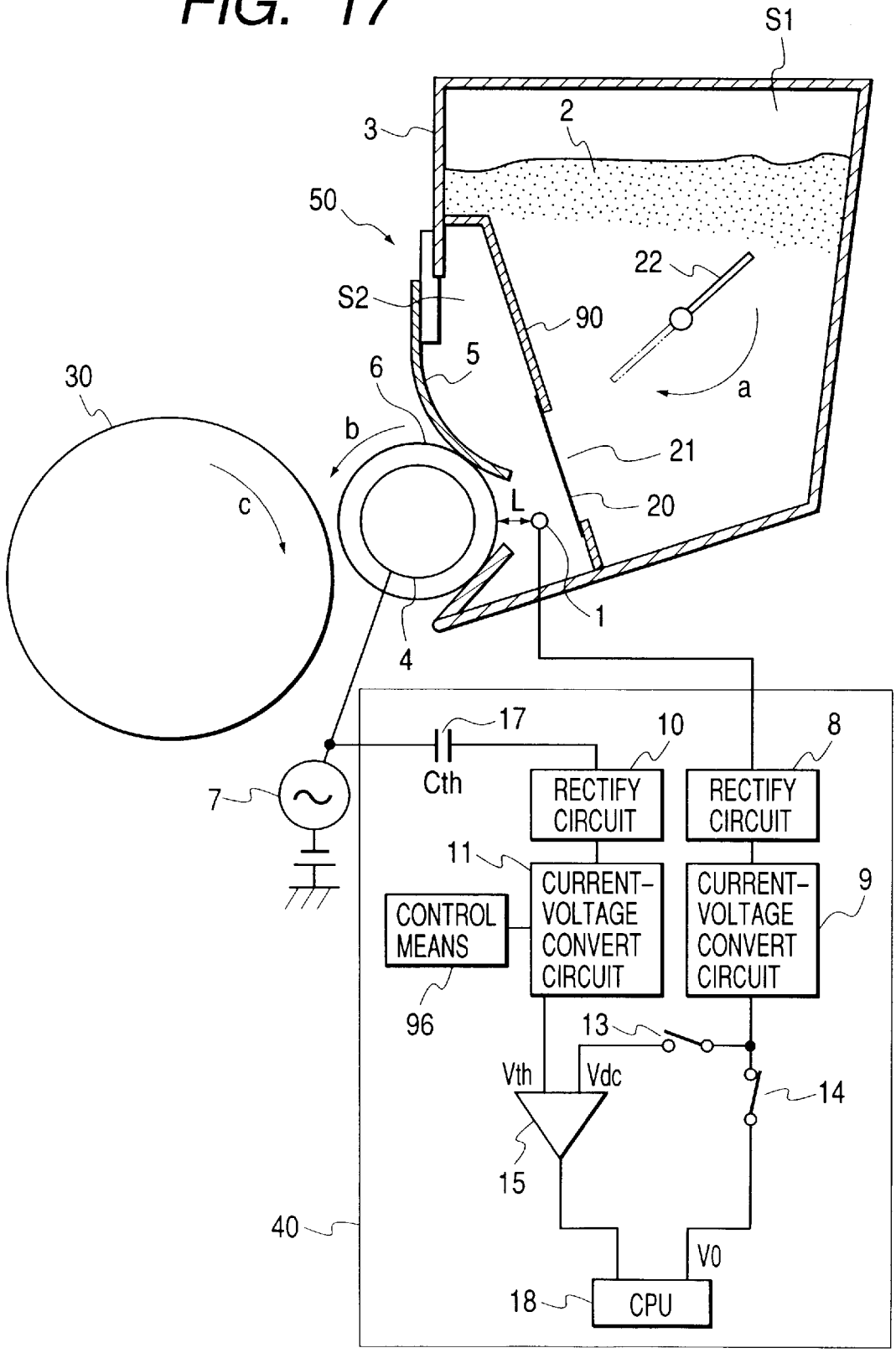
FIG. 17 is a constructural view of a developing agent amount detecting device according to a seventh embodiment of the present invention.
Figure 18:
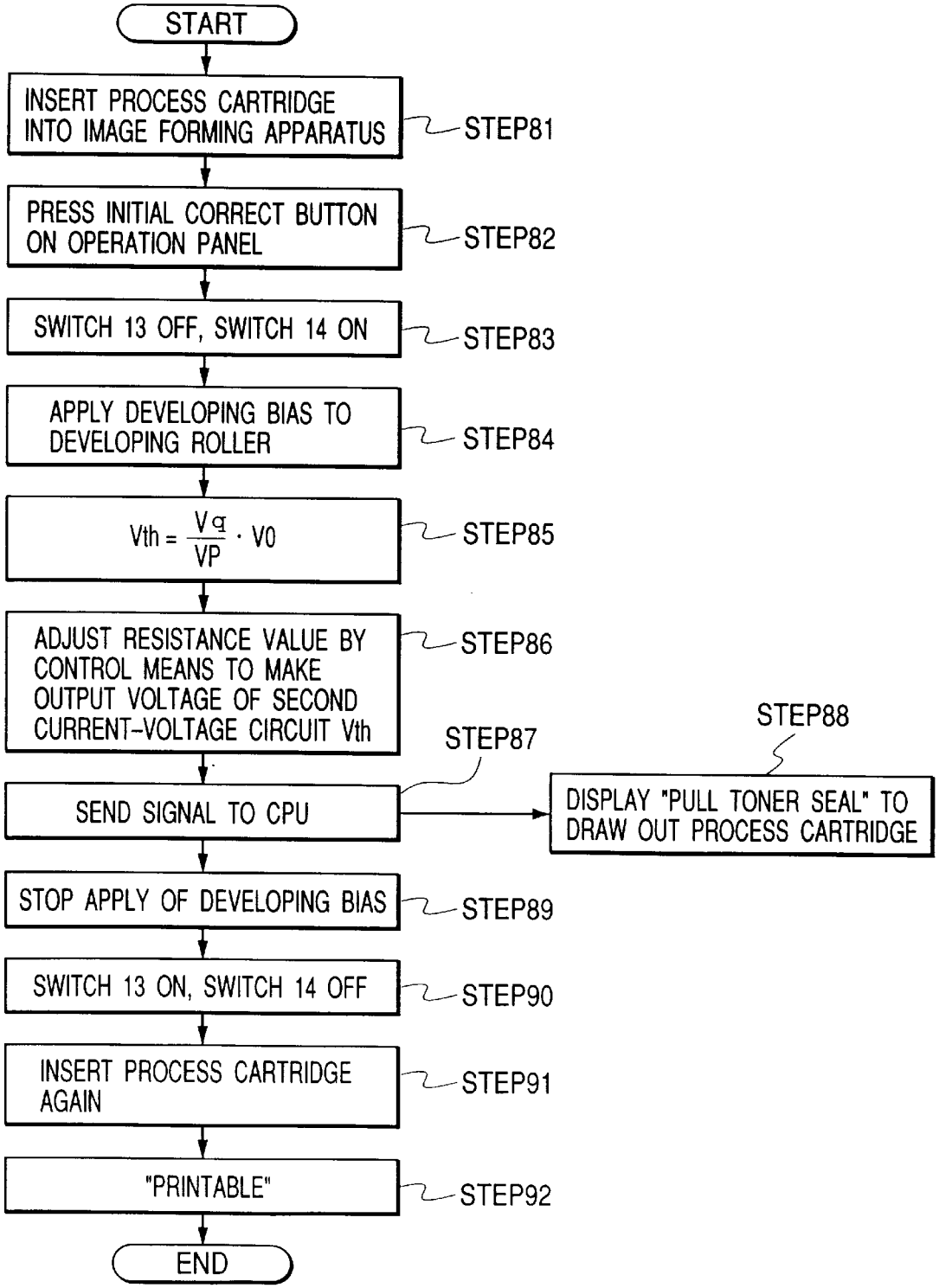
FIG. 18 is a flow chart showing a developing agent amount detecting method of the developing agent amount detecting device according to the seventh embodiment.

Next, a seventh embodiment of the present invention will be explained with reference to FIGS. 17 and 18. The characteristic of the seventh embodiment is that a remaining amount of developing agent is detected on the basis of current (as a reference) generated in the developing agent remaining amount detecting member 1 prior to image formation.

Now, a construction of a developing agent remaining amount detecting device according to this embodiment will be described with reference to FIG. 17.

A developing agent remaining amount detecting circuit 40 is connected to the developing agent remaining amount detecting member 1 in series and includes a first rectify circuit 8 for rectifying current generated in the developing agent remaining amount detecting member 1 in accordance with an amount of developing agent existing between the developing agent remaining amount detecting member 1 and the developing roller 6. The detecting circuit 40 further includes a first current-voltage convert circuit 9 having variable resistance therein and adapted to convert an electric signal generated in the first rectify circuit 8 into voltage.

The detecting circuit 40 further includes a capacitor 17 connected to the alternate current power source 7 in parallel with the developing roller 6 and having predetermined capacity Cth, a second rectify circuit 10 connected to the capacitor 17 in series, and a second current-voltage convert circuit 11. The detecting circuit 40 further includes a control means 96 for adjusting a value of the variable resistance of the second current-voltage convert circuit 11. The detecting circuit 40 further includes a first switch 14 disposed between the first current-voltage convert circuit 9 and a CPU 18.

The detecting circuit 40 further includes a second comparator 15, and a second switch 13 disposed between the second comparator 15 and the first current-voltage convert circuit 9. A voltage value Vdc outputted from the first current-voltage convert circuit 9 is compared with a voltage value Vth outputted from the second current-voltage convert circuit 11 by the second comparator 15, and, when these values are the same, a signal is emitted.

In the illustrated embodiment, prior to the image formation, an output voltage value Vth is determined on the basis of current (as a reference) generated in the developing agent remained amount detecting member 1.

That is to say, first of all, at a stage that the image forming apparatus is supplied from the factory, a developing unit to which the developing agent remaining amount detecting member 1 was previously attached with high accuracy is mounted to the main body of the image forming apparatus under a condition that the developing agent seal member 20 is attached, and an output voltage Vp at that time is measured. Thereafter, the developing unit is dismounted from the main body, and, after the developing agent seal member 20 is removed, the developing unit is mounted to the main body again. After image formation is effected, an output voltage Vq for warning the operator of the fact that the remained amount of the developing agent is small is measured. And, the output voltage value Vp and the output voltage value Vq are stored in the image forming apparatus.

The output voltage Vth is determined on the basis of the previously stored output voltage values Vp, Vq. More specifically, in association with voltage Vo converted by the first current-voltage convert circuit 9 from the current generated in the developing agent remained amount detecting member 1, the voltage Vth is determined as $(Vq/Vp)\times Vo$.

Incidentally, the signal emitted from the second comparator 15 is detected by the CPU 18. The CPU 18 serves to effect treatment, such as displaying of a warning about the developing agent remaining amount on the basis of the detected signal.

With the arrangement as mentioned above, the developing agent remaining amount detecting member 1 does not contact with the developing agent from the time when the process cartridge is manufactured to the time when the developing agent seal member 20 is removed by the operator for using the process cartridge.

Next, a method for detecting a remaining amount of the developing agent according to the illustrated embodiment will be explained with reference to a flow chart shown in FIG. 18.

First of all, the operator inserts the process cartridge 100 into the main body of the image forming apparatus before the developing agent seal member 20 is removed (step 81). Then, an initial correction button on an operation panel provided on a front surface of the main body is depressed (step 82). As a result, the first switch 14 in the developing agent remaining amount detecting circuit 40 is closed and the second switch 13 is opened (step 83).

Then, developing bias is applied from the alternate current power source 7 to the developing roller 6 (step 84). In this case, the output voltage Vo based on the current generated in the developing agent remaining amount detecting member 1 is detected by the CPU 18, and the output voltage Vth is determined (step 85). The variable resistance is adjusted by the control means 96 so that the output value of the second current-voltage convert circuit becomes Vth $(=(Vq/Vp)\times Vo)$ (step 86). After the adjustment is finished, a signal is sent to the CPU 18 (step 87).

As a result, the display of the words "draw out process cartridge from image forming apparatus; after removal of developing agent seal member, mount process cartridge to apparatus again" is effected (step 88). In this case, application of the developing bias is stopped (step 89), and the first switch 14 is opened and the second switch 13 is closed (step 90).

Then, the operator draws out the process cartridge 100 from the main body, then removes the developing agent seal member 20 and then inserts the process cartridge 100 into the main body again (step 91). At this point, the image forming apparatus 200 assumes a printable condition (step 92), and, thus, the desired image can be obtained.

Whenever image formation is effected, the voltage Vdc outputted on the basis of the electrostatic capacity changed in accordance with the amount of the developing agent existing between the developing roller 6 and the developing agent remaining amount detecting member 1 can be compared with the output voltage Vth from the second current-voltage convert circuit 11 by the comparator 15. As image formation is continued to gradually decrease the remaining amount of the developing agent in the developing container 3, if the output voltage Vdc coincides with the output voltage Vth, the signal is sent to the CPU 18. As a result, the fact that the remaining amount of the developing agent becomes small is displayed on the display panel of the image forming apparatus 200.

As mentioned above, an electrophotographic image forming apparatus for forming an image on a recording medium, comprises (a) a mounting portion capable of detachably mounting a developing unit including a developing member for developing a latent image formed on an electrophotographic photosensitive member, a developing agent containing portion for containing developing agent to be supplied to the developing member and a signal output member for outputting a signal corresponding to a remaining amount of developing agent contained in the developing unit, and (b) a remaining amount detecting portion for detecting the remaining amount of the developing agent contained in the developing unit when the developing unit is mounted to the mounting portion, the remaining amount detecting portion detecting a pre-signal outputted from the signal output member prior to image formation, thereby detecting the remaining amount of the developing agent on the basis of a detected result.

Here, the remaining amount detecting portion includes a convert portion for converting the signal outputted from the signal output member, and the convert portion converts the pre-signal to a signal having a predetermined value when a signal value after conversion of the pre-signal is deviated from a predetermined value, and, thereafter, the remaining amount detecting portion detects the remaining amount of the developing agent, and the signal output member is conductive, and the signal output member outputs current when alternate voltage is applied to the developing member.

The convert portion includes a current-voltage convert portion having a variable resistance and adapted to convert current into voltage, and the current-voltage convert portion converts current to voltage having a predetermined value by adjusting the variable resistance when a voltage value of the current as the pre-signal after conversion is deviated from a predetermined value, and, thereafter, the remaining amount detecting portion detects the remaining amount of the developing agent.

The remaining amount detecting portion detects the remaining amount of the developing agent on the basis of the detected pre-signal as a reference.

The developing agent containing portion includes a passage opening through which the developing agent passes when the developing agent is supplied to the developing member, and the remaining amount detecting portion detects the pre-signal in a condition that the passage opening is sealed by a seal member, prior to image formation.

The apparatus further comprises a seal releasing means for automatically unsealing the seal member from the opening.

The seal member is folded on the way and is secured, at its one end, to a wind member, and the opening is automatically opened by winding the seal member around the wind member which is being rotated, and the seal member comprises a rotatable lid, and the opening is automatically opened by rotating the lid.

The developing agent containing portion includes a passage opening through which the developing agent passes when the developing agent is supplied to the developing member, and the remaining amount detecting portion detects the pre-signal in a condition that the passage opening is opened by opening a seal member, prior to image formation.

The remaining amount detecting portion includes a memory portion for storing the predetermined value, and the remaining amount detecting portion further includes a read-out portion for reading out the predetermined value stored in the memory portion.

The apparatus further comprises an electrophotographic photosensitive member, and at least a charge member for charging the electrophotographic photosensitive member or a cleaning member for removing residual developing agent remaining on the electrophotographic photosensitive member.

Also a developing unit mountable to a main body of an electrophotographic image forming apparatus, comprises (a) a developing member for developing a latent image formed on an electrophotographic photosensitive member, (b) a developing agent containing portion for containing developing agent to be supplied to the developing member, (c) a signal output member for outputting a signal corresponding to a remaining amount of developing agent contained in the developing unit, and (d) a memory portion provided in the main body and adapted to store a predetermined value to be read out by a remaining amount detecting portion for detecting the remaining amount of the developing agent contained in the developing unit on the basis of the signal, wherein the predetermined value is read out by the remaining amount detecting portion prior to image formation, and the remaining amount detecting portion detects a pre-signal outputted from the signal output member prior to the image formation, thereby detecting the remaining amount of the developing agent on the basis of a detected result.

Also, a process cartridge mountable to a main body of an electrophotographic image forming apparatus, comprises (a) an electrophotographic photosensitive member, (b) a developing member for developing a latent image formed on the electrophotographic photosensitive member, (c) a developing agent containing portion for containing developing agent to be supplied to the developing member, (d) a signal output member for outputting a signal corresponding to a remaining amount of developing agent contained in the developing unit; and (e) a memory portion provided in the main body and adapted to store a predetermined value to be read out by a remaining amount detecting portion for detecting the remaining amount of the developing agent contained in the process cartridge on the basis of the signal; wherein the predetermined value is read out by the remaining amount detecting portion prior to image formation, and the remaining amount detecting portion detects a pre-signal outputted from the signal output member prior to the image formation, thereby detecting the remaining amount of the developing agent on the basis of a detected result.

As mentioned above, according to the illustrated embodiments, there can be provided an electrophotographic image forming apparatus, a developing unit and a process cartridge, in which a remaining amount of developing agent can be detected with high accuracy.

Further, according to the illustrated embodiments, there can be provided an electrophotographic image forming apparatus, a developing unit and a process cartridge, in which a remaining amount of developing agent can be detected with high accuracy by suppressing, influences on the positional accuracy of a signal output member for outputting a signal corresponding to the remaining amount of the developing agent and tolerances of parts constituting an electric circuit relating the signal detection.

What is claimed is:

1. An electrophotographic image forming apparatus for forming an image on a recording medium, comprising:

(a) a mounting portion configured to mount a developing unit including a developing member for developing a latent image formed on an electrophotographic photosensitive member, a developing agent containing portion for containing developing agent to be supplied to said developing member, and a signal output member for outputting a signal corresponding to the remaining amount of developing agent contained in said developing unit; and (b) a remaining amount detecting portion for detecting the remaining amount of the developing agent contained in said developing unit when said developing unit is mounted to said mounting portion, said remaining amount detecting portion detecting a signal outputted from said signal output member prior to image formation representing a value of a property of said remaining amount detecting portion and detecting a developing-agent remaining amount at least in part based on the detected signal.

2. An electrophotographic image forming apparatus according to claim 1, wherein said remaining amount detecting portion includes a convert portion for converting the signal outputted from said signal output member, and said convert portion converts the signal outputted prior to image formation to a signal having a predetermined value when a signal value after conversion of the signal outputted prior to image formation is deviated from a predetermined value, and, thereafter, said remaining mount detecting portion detects the remaining amount of the developing agent.

3. An electrophotographic image forming apparatus according to claim 2, wherein said signal output member is conductive, and said signal output member outputs current when alternate voltage is applied to said developing member.

4. An electrophotographic image forming apparatus according to claim 3, wherein said convert portion includes a current-voltage convert portion having a variable resistance and converts current into voltage, and said current-voltage convert portion converts current to voltage having a predetermined value by adjusting said variable resistance when a voltage value of the current as the signal after conversion is deviated from a predetermined value, and, thereafter, said remaining amount detecting portion detects the remaining amount of the developing agent.

5. An electrophotographic image forming apparatus according to claim 1, wherein said remaining amount detecting portion detects the remaining amount of the developing agent on the basis of the detected as a reference.

6. An electrophotographic image forming apparatus for forming an image on a recording medium, comprising:

(a) a mounting portion configured to mount a developing unit including a developing member for developing a latent image formed on an electrophotographic photosensitive member, a developing agent containing portion for containing developing agent to be supplied to said developing member and a signal output member for outputting a signal corresponding to a remaining amount of developing agent contained in said developing unit; and (b) a remaining amount detecting portion for detecting the remaining amount of the developing agent contained in said developing unit when said developing unit is mounted to said mounting portion, said remaining amount detecting portion detecting a signal outputted from said signal output member prior to image formation, thereby detecting the remaining amount of the developing agent on the basis of the detected result, wherein said developing agent containing portion includes a passage opening through which the developing agent passes when the developing agent is supplied to said developing member, and said remaining amount detecting portion detects the signal in a condition that said passage opening is sealed by a seal member, prior to image formation.

7. An electrophotographic image forming apparatus according to claim 6, further comprising seal releasing means for automatically unsealing said seal member from said opening.

8. An electrophotographic image forming apparatus according to claim 7, wherein said seal member is folded and is secured, at its one end, to a wind member, and said opening is automatically opened by winding said seal member around said wind member when said wind member is being rotated.

9. An electrophotographic image forming apparatus according to claim 7, wherein said seal member comprises a rotatable lid, and said opening is automatically opened by rotating said lid.

10. An electrophotographic image forming apparatus for forming an image on a recording medium, comprising:

(a) a mounting portion configured to mount a developing unit including a developing member for developing a latent image formed on an electrophotographic photosensitive member, a developing agent containing portion for developing agent to be supplied to said developing member and a signal output member for outputting a signal corresponding to a remained amount of developing agent contained in said developing unit; and (b) a remaining amount detecting portion for detecting the remaining amount of the developing agent contained in said developing unit when said developing unit is mounted to said mounting portion, said remaining amount detecting portion detecting a signal outputted from said signal output member prior to image formation, thereby detecting the remaining amount of the developing agent on the basis of the detected result, wherein said developing agent containing portion includes a passage opening through which the developing agent passage opening through which the developing agent passes when the developing agent is supplied to said developing member, and said remaining amount detecting portion detects the signal under a condition that said passage opening is opened by opening a seal member, prior to image formation.

11. An electrophotographic image forming apparatus according to claim 2, wherein said remaining amount detecting portion includes a memory portion for storing one of said predetermined values.

12. An electrophotographic image forming apparatus according to claim 11, wherein said remaining amount detecting portion further includes a read-out portion for reading out said one of said predetermined values stored in said memory portion.

13. An electrophotographic image forming apparatus according to claim 1, further comprising an electrophotographic photosensitive member, and at least a charge member for charging said electrophotographic photosensitive member or a cleaning member for removing residual developing agent remaining on said electrophotographic photosensitive member.

14. A developing unit mountable to a main body of an electrophotographic image forming apparatus, comprising:

(a) a developing member for developing a latent image formed on an electrophotographic photosensitive member;

(b) a developing agent containing portion for containing developing agent to be supplied to said developing member;

(c) a signal output member for outputting a signal corresponding to a remaining amount of developing agent contained in said developing unit; and (d) a memory portion provided in said main body and configured to store a predetermined value to be read out by a remaining amount detecting portion for detecting the remaining amount of the developing agent contained in the developing unit on the basis of said signal, wherein the predetermined value is read out by said remaining amount detecting portion prior to image formation, and said remaining amount detecting portion detects a signal outputted from said signal output member prior to the image formation, thereby detecting the remaining amount of the developing agent on the basis of the detected result.

15. A developing unit according to claim 14, further comprising a seal releasing means for automatically opening a seal member from an opening.

16. A developing unit according to claim 15, wherein said seal member is folded and is secured, at its one end, to a wind member, and said opening is automatically opened by winding said seal member around said wind member when said wind member is being rotated.

17. A developing unit according to claim 15, wherein said seal member comprises a rotatable lid, and said opening is automatically opened by rotating said lid.

18. A developing unit according to claim 14, further comprising an electrophotographic photosensitive member, and at least a charge member for charging said electrophotographic photosensitive member or a cleaning member for removing residual developing agent remaining on said electrophotographic photosensitive member.

19. A process cartridge mountable to a main body of an electrophotographic image forming apparatus, comprising:

(a) an electrophotographic photosensitive member;

(b) a developing unit including a developing member for developing a latent image formed on said electrophotographic photosensitive member;

(c) a developing agent containing portion for containing developing agent to be supplied to said developing member;

(d) a signal output member for outputting a signal corresponding to a remaining amount of developing agent contained in said developing unit; and (e) a memory portion provided in said main body and configured to store a predetermined value to be read out by a remaining amount detecting portion for detecting the remaining amount of the developing agent contained in the process cartridge on the basis of said signal;

wherein the predetermined value is read out by said remaining amount detecting portion prior to image formation, and said remaining amount detecting portion detects a signal outputted from said signal output member prior to the image formation, thereby detecting the remaining amount of the developing agent on the basis of the detected result.

20. A process cartridge according to claim 19, further comprising a seal releasing means for automatically opening a seal member from an opening.

21. A process cartridge according to claim 20, wherein said seal member is folded and is secured, at its one end, to a wind member, and said opening is automatically opened by winding said seal member around said wind member when said wind member is being rotated.

22. A process cartridge according to claim 20, wherein said seal member comprises a rotatable lid, and said opening is automatically opened by rotating said lid.

23. A process cartridge according to claim 19, further comprising at least a charge member for charging said electrophotographic photosensitive member or a cleaning member for removing residual developing agent remaining on said electrophotographic photosensitive member.

* * * * *

UNITED STATES PATENT AND TRADEMARK OFFICE

CERTIFICATE OF CORRECTION

PATENT NO. : 6,026,253

DATED : February 15, 2000

INVENTOR(S) : Akira DOMON, et al.

It is certified that error appears in the above-identified patent and that said Letters Patent is hereby corrected as shown below:

ON THE COVER PAGE:

At [56] References Cited, U.S. PATENT DOCUMENTS:

"Oshia et al." (both occurrences) should read --Oshida et al.--.

COLUMN 2:

Line 10, "the" should be deleted.
Line 29, "by" should read --by suppressing--.

COLUMN 4:

Line 43, "searingly" should read --sealingly--.
Line 62, "above mentioned" should read --above-mentioned--.
Line 64, "remained" should read --remaining--.

COLUMN 5:

Line 11, "width WI" should read --width W1--.
Line 14, "searingly" should read --sealingly--.

UNITED STATES PATENT AND TRADEMARK OFFICE

CERTIFICATE OF CORRECTION

PATENT NO. : 6,026,253

DATED : February 15, 2000

INVENTOR(S) : Akira DOMON, et al.

It is certified that error appears in the above-identified patent and that said Letters Patent is hereby corrected as shown below:

COLUMN 6:

Line 15, "of" should read --of a--.
Line 16, "of a" should read --of the--.
Line 36, "anew" should read --a new--.

COLUMN 7:

Line 41, "de" should read --is--.
Line 56, "redused," should read --reduced,--.

COLUMN 9:

Line 54, "resistance" should read --resistance,--.

COLUMN 10:

Line 1, "that" should be deleted.

UNITED STATES PATENT AND TRADEMARK OFFICE

CERTIFICATE OF CORRECTION

PATENT NO. : 6,026,253

DATED : February 15, 2000

INVENTOR(S) : Akira DOMON, et al.

It is certified that error appears in the above-identified patent and that said Letters Patent is hereby corrected as shown below:

COLUMN 11:

Line 56, "aagent" should read --agent--.

COLUMN 12:

Line 2, "value" should read --value,--.
Line 24, "remained" should read --remaining--.,
Line 39, "is" should read --is controlled--.

COLUMN 13:

Line 51, "member 1" should read --member 1,--

COLUMN 14:

Line 1, "podevelopt" should read --point that--.

COLUMN 15:

Line 27, "with" should be deleted.

UNITED STATES PATENT AND TRADEMARK OFFICE

CERTIFICATE OF CORRECTION

PATENT NO. : 6,026,253

DATED : February 15, 2000

INVENTOR(S) : Akira DOMON, et al.

It is certified that error appears in the above-identified patent and that said Letters Patent is hereby corrected as shown below:

COLUMN 17:

Line 66, "suppressing," should read --suppressing--.

COLUMN 18:

Line 54, "detected" should read --detected signal--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*